US010197934B2

(12) United States Patent
Matsui et al.

(10) Patent No.: US 10,197,934 B2
(45) Date of Patent: Feb. 5, 2019

(54) TONER, DEVELOPING APPARATUS, AND IMAGE-FORMING APPARATUS PROVIDED WITH TONER

(71) Applicant: CANON KABUSHIKI KAISHA, Tokyo (JP)

(72) Inventors: Takashi Matsui, Mishima (JP); Naoki Okamoto, Mishima (JP); Yuujirou Nagashima, Susono (JP); Keisuke Tanaka, Yokohama (JP); Shohei Tsuda, Suntou-gun (JP); Kosuke Fukudome, Tokyo (JP); Takuya Mizuguchi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/631,186

(22) Filed: Jun. 23, 2017

(65) Prior Publication Data

US 2018/0004109 A1 Jan. 4, 2018

(30) Foreign Application Priority Data

Jun. 30, 2016 (JP) ..... 2016-130188

(51) Int. Cl.

| | |
|---|---|
| ***G03G 9/08*** | (2006.01) |
| ***G03G 9/087*** | (2006.01) |
| ***G03G 9/083*** | (2006.01) |

(52) U.S. Cl.

CPC ..... *G03G 9/08797* (2013.01); *G03G 9/083* (2013.01); *G03G 9/0819* (2013.01); *G03G 9/0821* (2013.01); *G03G 9/0825* (2013.01); *G03G 9/08702* (2013.01); *G03G 9/08708* (2013.01); *G03G 9/08711* (2013.01); *G03G 9/08733* (2013.01); *G03G 9/08755* (2013.01); *G03G 9/08782* (2013.01); *G03G 9/08795* (2013.01)

(58) Field of Classification Search

CPC ..... G03G 9/08755; G03G 9/0821
USPC ..... 430/109.4, 111.4
See application file for complete search history.

(56) References Cited

U.S. PATENT DOCUMENTS

| | | | |
|---|---|---|---|
| 4,657,838 | A | 4/1987 | Fukumoto et al. |
| 4,673,631 | A | 6/1987 | Fukumoto et al. |
| 4,710,443 | A | 12/1987 | Tanaka et al. |
| 4,737,432 | A | 4/1988 | Tanaka et al. |
| 4,839,255 | A | 6/1989 | Hyosu et al. |
| 4,886,725 | A | 12/1989 | Tanaka et al. |
| 5,071,727 | A | 12/1991 | Ikeda et al. |

(Continued)

FOREIGN PATENT DOCUMENTS

| | | | |
|---|---|---|---|
| JP | 2005-173484 | A | 6/2005 |
| JP | 2015-052643 | A | 3/2015 |

(Continued)

*Primary Examiner* — Mark A Chapman
(74) *Attorney, Agent, or Firm* — Venable LLP

(57) ABSTRACT

A toner having a toner particle containing a binder resin, an amorphous polyester, and a colorant, wherein a softening point of the toner is at least 110° C. and not more than 140° C.; an integrated value f1 for stress of the toner is not more than 10 g·m/sec, as measured using a tack tester, with a temperature for a probe end being 150° C. and a press holding time being 0.01 seconds; and an integrated value f2 for stress of the toner is at least 30 g·m/sec, as measured using a tack tester, with a temperature for a probe end being 150° C. and a press holding time being 0.1 seconds.

15 Claims, 5 Drawing Sheets

(56) References Cited

U.S. PATENT DOCUMENTS

| | | | |
|---|---|---|---|
| 5,246,810 | A | 9/1993 | Hagiwara et al. |
| 5,288,579 | A | 2/1994 | Tanaka et al. |
| 5,306,588 | A | 4/1994 | Tanaka et al. |
| 5,356,749 | A | 10/1994 | Hagiwara et al. |
| 5,508,139 | A | 4/1996 | Tanaka et al. |
| 7,361,400 | B2 | 4/2008 | Shimamura et al. |
| 7,396,626 | B2 | 7/2008 | Fujikawa et al. |
| 7,396,629 | B2 | 7/2008 | Baba et al. |
| 7,611,813 | B2 | 11/2009 | Ida et al. |
| 7,629,100 | B2 | 12/2009 | Okamoto et al. |
| 7,678,523 | B2 | 3/2010 | Hiroko et al. |
| 7,842,446 | B2 | 11/2010 | Yanase et al. |
| 7,906,262 | B2 | 3/2011 | Ishigami et al. |
| 7,923,190 | B2 | 4/2011 | Magome et al. |
| 7,935,467 | B2 | 5/2011 | Dojo et al. |
| 8,298,742 | B2 | 10/2012 | Okamoto et al. |
| 8,426,091 | B2 | 4/2013 | Magome et al. |
| 8,426,094 | B2 | 4/2013 | Magome et al. |
| 8,614,044 | B2 | 12/2013 | Matsui et al. |
| 8,778,585 | B2 | 7/2014 | Matsui et al. |
| 8,841,054 | B2 | 9/2014 | Dojo et al. |
| 8,883,389 | B2 | 11/2014 | Matsui et al. |
| 8,945,805 | B2 | 2/2015 | Baba et al. |
| 9,034,549 | B2 | 5/2015 | Shiotari et al. |
| 9,034,551 | B2 | 5/2015 | Endo et al. |
| 9,040,216 | B2 | 5/2015 | Fukudome et al. |
| 9,046,800 | B2 | 6/2015 | Hotta et al. |
| 9,097,997 | B2 | 8/2015 | Nomura et al. |
| 9,116,448 | B2 | 8/2015 | Terauchi et al. |
| 9,134,637 | B2 | 9/2015 | Hotta et al. |
| 9,141,012 | B2 | 9/2015 | Moribe et al. |
| 9,213,250 | B2 | 12/2015 | Nomura et al. |
| 9,213,251 | B2 | 12/2015 | Ohmori et al. |
| 9,217,943 | B2 | 12/2015 | Matsui et al. |
| 9,235,151 | B2 | 1/2016 | Tanaka et al. |
| 9,239,528 | B2 | 1/2016 | Hasegawa et al. |
| 9,256,148 | B2 | 2/2016 | Fujikawa et al. |
| 9,261,806 | B2 | 2/2016 | Moribe et al. |
| 9,285,697 | B2 | 3/2016 | Fukudome et al. |
| 9,304,422 | B2 | 4/2016 | Matsui et al. |
| 9,348,246 | B2 | 5/2016 | Magome et al. |
| 9,354,545 | B2 | 5/2016 | Matsui et al. |
| 9,442,416 | B2 | 9/2016 | Magome et al. |
| 9,442,419 | B2 | 9/2016 | Wakabayashi et al. |
| 9,470,993 | B2 | 10/2016 | Nishikawa et al. |
| 9,575,425 | B2 | 2/2017 | Naka et al. |
| 9,581,934 | B2 | 2/2017 | Ito et al. |
| 9,588,450 | B2 | 3/2017 | Tsuda et al. |
| 9,606,462 | B2 | 3/2017 | Nomura et al. |
| 9,658,546 | B2 | 5/2017 | Tanaka et al. |
| 9,715,188 | B2 | 7/2017 | Terauchi et al. |
| 2005/0196201 | A1 | 9/2005 | Hagiwara et al. |
| 2009/0197192 | A1 | 8/2009 | Hiroko et al. |
| 2015/0064616 | A1 | 3/2015 | Sekiguchi et al. |
| 2015/0125790 | A1 | 5/2015 | Hotta et al. |
| 2015/0185658 | A1 | 7/2015 | Wakabayashi et al. |
| 2015/0227067 | A1 | 8/2015 | Hasegawa et al. |
| 2015/0227068 | A1 | 8/2015 | Sano et al. |
| 2015/0227069 | A1 | 8/2015 | Sugama et al. |
| 2016/0041482 | A1 | 2/2016 | Terauchi et al. |
| 2016/0041484 | A1 | 2/2016 | Tsuda et al. |
| 2016/0070188 | A1 | 3/2016 | Fujisaki et al. |
| 2016/0139521 | A1 | 5/2016 | Tsuda et al. |
| 2016/0202624 | A1 | 7/2016 | Nishikawa et al. |
| 2016/0266509 | A1 | 9/2016 | Sano et al. |
| 2016/0378003 | A1 | 12/2016 | Arimura et al. |
| 2017/0123333 | A1 | 5/2017 | Kuroki et al. |
| 2017/0160657 | A1 | 6/2017 | Suzumura et al. |
| 2017/0160660 | A1 | 6/2017 | Hasegawa et al. |
| 2017/0160661 | A1 | 6/2017 | Suzumura et al. |
| 2017/0160662 | A1 | 6/2017 | Nagashima et al. |
| 2017/0199475 | A1 | 7/2017 | Fukudome et al. |

FOREIGN PATENT DOCUMENTS

| | | | |
|---|---|---|---|
| JP | 2015-152703 | A | 8/2015 |
| JP | 2016-057382 | A | 4/2016 |

TONER, DEVELOPING APPARATUS, AND IMAGE-FORMING APPARATUS PROVIDED WITH TONER

BACKGROUND OF THE INVENTION

Field of the Invention

The present invention relates to a toner used in electrophotography, in image-forming methods for visualizing an electrostatic image, and in the toner jet method. The present invention also relates to a developing apparatus and an image-forming apparatus that are provided with this toner.

Description of the Related Art

Printers and copiers have in recent years been undergoing a transition from analog to digital, which has resulted in an excellent latent image reproducibility and high resolution, while at the same time there has been strong demand for size reduction in particular with printers.

In the past, a printer was frequently used connected to a network and a large number of individuals would then print to this printer. However, in recent years there has also been strong demand for locating both a personal computer (PC) and a printer at an individual's desk in order to carry out local printing. As a consequence, there is strong demand to reduce the size of printers in order to save on space.

Moreover, there is also great demand that such compact printers also deliver a high image quality as well as a high stability whereby little fluctuation in image quality occurs even during long-term use.

Here, when the focus is on reducing printer size, primarily downsizing the fixing unit and downsizing the image-forming apparatus are effective for size reduction.

First, film fixing is preferably adopted in order to support downsizing of the fixing unit. Film fixing facilitates a simplification of the heat source and apparatus structure and is easily applied. Toner that can be fixed at low pressures with small amounts of heat is required for this film fixing.

A cleanerless system is preferably adopted in order to reduce the size of the image-forming apparatus. A cleanerless system lacks a cleaning blade and cleaner container and recovers the toner remaining post-transfer on the electrostatic latent image-bearing member (also referred to as "untransferred toner" in the following) to the developing device using a toner-bearing member, and as a consequence enables a substantial reduction in the size of the image-forming apparatus (Japanese Patent Application Laid-open No. 2005-173484).

Japanese Patent Application Laid-open No. 2015-152703 proposes, as a toner having an improved fixing performance, a toner for developing electrostatic images that characteristically comprises a toner particle that contains a colorant and a binder resin containing an amorphous resin (A) and an amorphous polyester resin (B) different from the amorphous resin (A). The toner particle has a domain-matrix structure in which the amorphous polyester resin (B) is dispersed as a domain phase in a matrix phase comprising the amorphous resin (A). In an observed image of the toner particle cross section, the domain phase due to amorphous polyester resin (B) having a domain diameter of at least 100 nm has a number-average domain diameter of 100 to 200 nm, and the ratio of the area of the domain phase having a domain diameter of at least 500 nm with respect to the total area of the domain phase is 0% to 10%.

SUMMARY OF THE INVENTION

Characteristic problems are also present with cleanerless systems.

In a cleanerless system, the untransferred toner passes through a charging step and is again recovered into the developing device. Due to this, stress is applied between members not only in the developing step, but also in the charging step and the recovery step, and toner deterioration, i.e., the embedding of external additives and toner cracking, then readily occurs.

This toner deterioration, for example, tends to increase the occurrences of poor control at the toner control member within the image-forming apparatus and facilitates the production of development ghosts.

The following are necessary in order to suppress these development ghosts: improvements in the transferability, a suppression of the embedding of external additives, and improvements in toner brittleness.

As noted above, cleanerless systems and downsizing the fixing unit through the application of film fixing are effective for reducing printer size. Toner that can accommodate such printers must have an improved transferability, must exhibit a suppression of the embedding of external additives, must have an improved toner brittleness, and must be capable of executing fixing at low pressures and small amounts of heat.

Moreover, as indicated above, the fixing performance of toner has been improved through improvements in the binder resin and/or polyester resin. However, in the case of image-forming apparatuses that have adopted a cleanerless system, there is still room for investigation due to the appearance of the following: a phenomenon, associated with a reduced transferability and poor control, in which the toner is scattered at the back edge of an image (also referred to as "fixation tailing" in the following) upon long-term use, and development ghosts associated with poor control.

Thus, the present invention provides a toner that, even during long-term use, can provide an image in which development ghosts and fixation tailing are suppressed. The present invention also provides a developing apparatus and an image-forming apparatus that are provided with this toner.

The present invention is a toner containing a toner particle that contains a binder resin, an amorphous polyester, and a colorant, wherein a softening point of the toner is at least 110° C. and not more than 140° C.; an integrated value f1 for stress of the toner is not more than 10 g·m/sec, as measured using a tack tester, with a temperature for a probe end being 150° C. and a press holding time being 0.01 seconds; and an integrated value f2 for stress of the toner is at least 30 g·m/sec, as measured using a tack tester, with a temperature for a probe end being 150° C. and a press holding time being 0.1 seconds.

The present invention is also a toner containing a toner particle that contains a colorant, an amorphous polyester, and a binder resin containing a vinyl resin, wherein a softening point of the toner is at least 110° C. and not more than 140° C.; the amorphous polyester has a monomer unit derived from a linear aliphatic dicarboxylic acid having at least 6 and not more than 12 carbons and a monomer unit derived from an alcohol component; a content of the monomer unit derived from a linear aliphatic dicarboxylic acid having at least 6 and not more than 12 carbons is at least 10 mol % and not more than 50 mol % relative to a total monomer unit derived from a carboxylic acid component constituting the amorphous polyester; and, in a cross section of the toner particle observed with a transmission electron microscope, the vinyl resin forms a matrix and the amorphous polyester forms a domain, a number-average diameter of the domain of the amorphous polyester is at least 0.3 μm and not more than 3.0 μm, and a proportion for the domain of the amorphous polyester present in a region within 25% of a distance from a contour of the cross section to a centroid of the cross section is at least 30 area % and not more than 70 area % relative to a total area of the domain of the amorphous polyester.

The present invention is also a developing apparatus comprising a toner for developing an electrostatic latent image formed on an electrostatic latent image bearing member, and a toner bearing member for carrying the toner and transporting the toner to the electrostatic latent image bearing member, wherein the toner is the toner according to the present invention.

The invention is also an image forming apparatus comprising an electrostatic latent image bearing member; a charging member for charging the electrostatic latent image bearing member; a toner for developing an electrostatic latent image formed on the electrostatic latent image bearing member; and a toner bearing member for contacting the electrostatic latent image bearing member and transporting toner, wherein the toner bearing member recovers the toner remaining on the electrostatic latent image bearing member after transfer, the toner is the toner according to the present invention.

Further features of the present invention will become apparent from the following description of exemplary embodiments with reference to the attached drawings.

DESCRIPTION OF THE EMBODIMENTS

Figure 1:
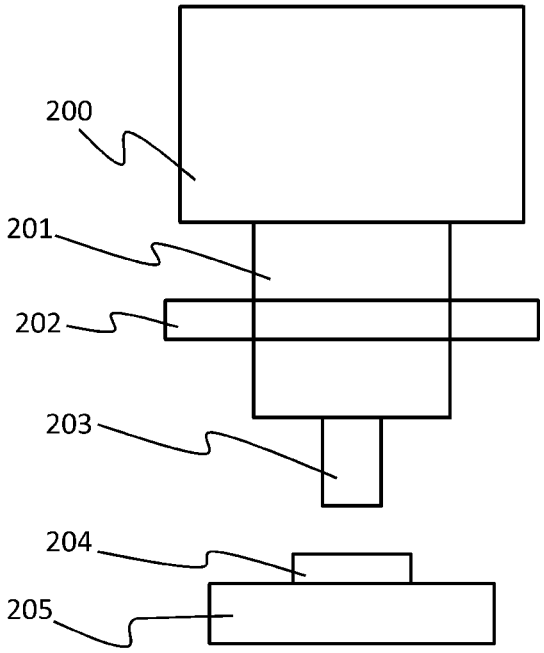
FIG. 1 is a schematic diagram of a tack tester.

Unless specifically indicated otherwise, expressions such as "at least XX and not more than YY", "XX-YY" and "XX to YY" that show numerical value ranges refer in the present invention to numerical value ranges that include the lower limit and upper limit that are the end points.

The toner of the present invention is a toner having a toner particle that contains a binder resin, an amorphous polyester, and a colorant, wherein the softening point of the toner is at least 110° C. and not more than 140° C.; an integrated value f1 for the stress of the toner is not more than 10 g·m/sec, as measured using a tack tester, with a temperature for the probe end being 150° C. and a press holding time being 0.01 seconds; and an integrated value f2 for the stress of the toner is at least 30 g·m/sec, as measured using a tack tester, with a temperature for the probe end being 150° C. and a press holding time being 0.1 seconds.

The phenomenon of toner scattering at the back edge of an image during fixation (i.e., fixation tailing) will be considered first. The occurrence of fixation tailing is hypothesized to be caused by the sudden generation of a water vapor flow from the media, e.g., paper, due to the heat applied from the fixing unit during fixation, causing the toner to be blown off. In particular, it readily occurs when the toner on a line in a line image, e.g., a horizontal line, assumes a high height as well as when the toner is nonuniformly laid on the media.

Thus, the following are required in order to suppress this fixation tailing: it must be possible for toner-to-toner and toner-to-media adhesion to occur instantaneously upon the application heat from the fixing unit; in addition, the unfixed toner must be uniformly laid on the media and the height of the toner must not be too high.

However, when stress is applied between members as in a cleanerless system as described above, toner deterioration, i.e., embedding of external additives and toner cracking, readily occurs and a reduction in toner flowability then also readily occurs.

When the toner flowability is reduced, poor control is prone to occur at the toner control zone within the image-forming apparatus between the toner-bearing member and the toner control member and a state is readily assumed of a high toner height on the lines in a line image, such as horizontal lines.

In addition, when a toner that has undergone deterioration, e.g., embedding of external additives and/or toner cracking, is transferred to, e.g., the media, from the electrostatic latent image-bearing member, an inadequate transfer is obtained and the toner laid-on state on the media readily becomes nonuniform.

Thus, fixation tailing is readily produced during long-term use in a cleanerless system. In addition, not only fixation tailing, but development ghosts associated with the aforementioned poor control are also seen.

The toner durability and the toner adhesiveness must coexist in order to suppress this fixation tailing and development ghosts.

Core-shell toner structures have been investigated in order to bring about coexistence between the durability and fixing performance of a toner. This core-shell toner forms a structure that has a high softening point material in the shell portion and that has a low softening point material and/or a plasticizing agent such as a release agent in the core portion.

However, in the case of long-term use in an image-forming apparatus that is prone to apply stress to the toner, as in a cleanerless system, even when a high softening point material is present in the shell portion, the core portion is soft and due to this toner deterioration, i.e., toner cracking, has readily appeared.

As a result, development ghosts due to poor control and fixation tailing due to poor control, poor transfer, and poor adhesiveness have been inadequately suppressed. In particular, poor transfer due to toner deterioration has been prone to be substantial in high-temperature, high-humidity environments.

Upon carrying out detailed investigations, the present inventors then discovered that—by having the softening point of the toner take on specific values and by having special values for the integrated values of the stress for the toner, as measured with a tack tester using 150° C. for the temperature of the probe end and using 0.01 seconds and 0.1 seconds for the press holding time—an image could be obtained for which development ghosts and fixation tailing were suppressed even during long-term use.

That is, toner deterioration, i.e., embedding of the external additives and toner cracking, can be suppressed, even during long-term use, by having the softening point of the toner take on special values.

In addition, special values are also used for the integrated values of the stress measured using a tack tester. This makes it possible for the toner adhesiveness during fixing to coexist with the toner flowability during image formation and during transfer, and as a consequence an image can be obtained for which development ghosts and fixation tailing are suppressed even during long-term use.

The present invention is described in detail herebelow.

The softening point of the toner is at least 110° C. and not more than 140° C., preferably at least 120° C. and not more than 140° C., and more preferably at least 125° C. and not more than 135° C.

Control of the softening point of the toner is crucial for suppressing toner deterioration in systems in which stress is readily applied to the toner between members, as in a cleanerless system.

When the softening point of the toner is at least 110° C., toner deterioration, i.e., embedding of the external additives and toner cracking, can also be suppressed at normal temperatures. The softening point of the toner, on the other hand, is not more than 140° C. based on a consideration of the fixing performance. When the softening point of the toner is not more than 140° C., the toner is then able to undergo deformation when heat and pressure are applied from the fixing unit.

The softening point of the toner may be adjusted into the indicated range through adjustment of the molecular weight of the toner, the type and molecular weight of the binder resin constituting the toner, and the type and content of the plasticizing agent, such as a wax.

As indicated above, f1 is not more than 10 g·m/sec and f2 is at least 30 g·m/sec where f1 is the integrated value of the stress for the toner as measured using a tack tester and 150° C. for the temperature of the probe end and 0.01 seconds for the press holding time and f2 is the integrated value of the stress for the toner as measured using a tack tester and a temperature for the probe end of 150° C. and 0.1 seconds for the press holding time. The transferability can coexist with suppression of fixation tailing when the toner satisfies these conditions.

A correlation was discovered between the particular measurement temperature and holding time in tack testing and the toner particle-to-toner particle adhesiveness and toner/media adhesiveness during fixing. It was found that fixation tailing could be suppressed when, based on this correlation, each of the integration values for the stress for the toner was brought to a special value.

First, f2 is at least 30 g·m/sec and is more preferably at least 35 g·m/sec and even more preferably at least 40 g·m/sec. There is no particular limitation on the upper limit, but not more than 100 g·m/sec is preferred and not more than 70 g·m/sec is more preferred.

The fixation tailing is suppressed when f2 is at least 30 g·m/sec because this enables an instantaneous toner particle-to-toner particle adhesion and toner/media adhesion to occur when heat and pressure are applied from the fixing unit. Bringing about an increase in the adhesiveness in the vicinity of the toner particle surface is crucial for bringing this f2 to at least 30 g·m/sec. The increase in the adhesiveness in the vicinity of the toner particle surface is preferably brought about by locating a low softening point resin in the vicinity of the toner particle surface.

When the press holding time at 150° C. is a short period of time, i.e., 0.1 seconds, it is then difficult for heat conduction to reach into the interior of the toner particle and as a consequence it is difficult to realize an increased adhesiveness even when the softening point of the toner particle interior has been lowered. Moreover, when a high softening point material is present at the toner particle surface as in conventional core-shell structures, melting in the vicinity of the toner particle surface is then further impeded and the realization of an increase in the adhesiveness is impeded.

When, on the other hand, a low softening point resin is present in the vicinity of the toner particle surface, melting can occur in the vicinity of the toner particle surface even when the press holding time at 150° C. is a short period of time, i.e., 0.1 seconds, and as a consequence f2 is easily controlled to be at least 30 g·m/sec.

When a low softening point material such as the release agent is present in the vicinity of the toner particle surface, melting does occur in the vicinity of the toner particle surface, but it is difficult to realize adhesive strength, making this disfavored.

On the other hand, an increase in the adhesive strength is readily brought about with a resin that has a structure in which the molecules are entangled, as with a vinyl resin or amorphous polyester.

The aforementioned f1, on the other hand, is not more than 10 g·m/sec and is preferably not more than 8 g·m/sec and more preferably not more than 6 g·m/sec. While there is no particular limitation on the lower limit, it is preferably at least 1 g·m/sec.

f1, which is measured at 150° C. at the very short time interval of 0.01 seconds for the press holding time, is hypothesized to correlate with the integrated value of the stress for the toner under normal conditions, such as normal temperature.

That is, when this f1 is not more than 10 g·m/sec, the toner particle-to-toner particle attachment force in the developing step and transfer step is reduced and due to this a suppression of control defects and a high transferability can be realized.

For example, adjustment of the structure in the vicinity of the toner particle surface may be used to bring f1 to equal to or less than 10 g·m/sec.

The binder resin in the toner preferably contains a vinyl resin.

Having the binder resin contain vinyl resin facilitates control of the softening point of the toner and facilitates suppression of toner deterioration during long-term use. In order to bring about additional improvements in this control and suppression, the binder resin more preferably is vinyl resin. Moreover, insofar as the effects of the present invention are not impaired, the binder resin may contain resins known for use in the binder resins of toners.

The vinyl resin is exemplified as follows.

The following can be used:

homopolymers of styrene and of its substituted forms, e.g., polystyrene and polyvinyltoluene;

styrene copolymers such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, and styrene-maleate ester copolymers; as well as polymethyl methacrylate, polybutyl methacrylate, polyvinyl acetate, polyethylene, polypropylene, polyvinyl butyral, and polyacrylic acid resins. These can be used either individually or in combinations of a plurality of species. Among the preceding, styrene copolymers are preferred from the standpoint of, e.g., the developing characteristics and fixing performance. In addition, styrene-butyl acrylate copolymers are more preferred because they also support a reduction in the hygroscopicity and can improve the transferability in high-temperature, high-humidity environments.

The amorphous polyester preferably has a monomer unit derived from an alcohol component and a monomer unit derived from a linear aliphatic dicarboxylic acid having at least 6 and not more than 12 carbons, and the content of the monomer unit derived from linear aliphatic dicarboxylic acid having at least 6 and not more than 12 carbons is preferably at least 10 mol % and not more than 50 mol % relative to the total monomer unit derived from the carboxylic acid component constituting the amorphous polyester.

Here, monomer unit refers to the state of the reacted monomeric substance in the polymer.

By having the content of monomer units derived from linear aliphatic dicarboxylic acid having at least 6 and not more than 12 carbons be at least 10 mol % and not more than 50 mol % relative to the total monomer units derived from carboxylic acid component constituting the amorphous polyester, the softening point of the amorphous polyester is then readily lowered in a state in which the peak molecular weight of the amorphous polyester is increased. This then facilitates the coexistence of a high durability with a high adhesiveness.

For example, considering the case of the use of an amorphous polyester having a monomer unit derived from aromatic dicarboxylic acid and a monomer unit derived from an alcohol component rather than the use of the amorphous polyester containing the specific amount of monomer unit derived from the special linear aliphatic dicarboxylic acid described above, the peak molecular weight is reduced when the softening point of the amorphous polyester is lowered in order to maintain a high adhesiveness, and the durability then assumes a declining trend due to this reduction in the peak molecular weight.

In addition, having the amorphous polyester contain, as a constituent component thereof, a specific amount of monomer unit derived from a linear aliphatic dicarboxylic acid having at least 6 and not more than 12 carbons, makes it possible for instantaneous melting to occur during fixing, which as a consequence facilitates the generation of a high adhesiveness.

This phenomenon is hypothesized to be caused by the linear aliphatic dicarboxylic acid segment undergoing folding and the amorphous polyester then readily assuming a structure like a pseudocrystalline state.

That is, viewed in terms of the formation of a pseudocrystalline state, the number of carbons in this linear aliphatic dicarboxylic acid is preferably at least 6 and not more than 12 and is more preferably at least 6 and not more than 10.

When the number of carbons in the linear aliphatic dicarboxylic acid is at least 6, the linear aliphatic dicarboxylic acid segment then readily undergoes folding and due to this a structure like a pseudocrystalline state is easily formed and instantaneous melting during fixing can occur, and as a consequence a high adhesiveness is readily generated.

When, on the other hand, the number of carbons in the linear aliphatic dicarboxylic acid is not more than 12, control of the softening point and peak molecular weight of the amorphous polyester is facilitated and as a consequence coexistence between the durability and adhesiveness is readily achieved.

The content of monomer units derived from linear aliphatic dicarboxylic acid having at least 6 and not more than 12 carbons, expressed relative to the total monomer units derived from carboxylic acid component constituting the amorphous polyester, is preferably at least 10 mol % and not more than 50 mol % and is more preferably at least 15 mol % and not more than 45 mol %.

The softening point of the amorphous polyester is easily lowered when this content is at least 10 mol %. On the other hand, it is difficult to cause a reduction in the peak molecular weight of the amorphous polyester when this content is not more than 50 mol %.

The carboxylic acid component for obtaining the amorphous polyester can be exemplified by linear aliphatic dicarboxylic acids having at least 6 and not more than 12 carbons and by other carboxylic acids.

Examples of linear aliphatic dicarboxylic acids having at least 6 and not more than 12 carbons are adipic acid, suberic acid, sebacic acid, and dodecanedioic acid.

Carboxylic acids other than linear aliphatic dicarboxylic acids having at least 6 and not more than 12 carbons can be exemplified by the following.

Examples of a dibasic carboxylic acid component are maleic acid, fumaric acid, phthalic acid, isophthalic acid, terephthalic acid, succinic acid, glutaric acid, and n-dodecenylsuccinic acid and their anhydrides and lower alkyl esters.

Examples of an at least tribasic polybasic carboxylic acid component are 1,2,4-benzenetricarboxylic acid, 2,5,7-naphthalenetricarboxylic acid, pyromellitic acid, and Empol trimer acid and their anhydrides and lower alkyl esters.

Terephthalic acid is preferably used among the preceding because it enables the maintenance of a high peak molecular weight and facilitates maintenance of the durability.

The alcohol component for obtaining the amorphous polyester can be exemplified by the following in addition to bisphenol A and its derivatives, for example, propylene oxide adducts on bisphenol A.

Examples of a dihydric alcohol component are ethylene oxide adducts on bisphenol A, ethylene glycol, 1,3-propylene glycol, and neopentyl glycol.

Examples of an at least trihydric alcohol component are sorbitol, pentaerythritol, and dipentaerythritol.

A single one of these dihydric alcohol components can be used by itself or a combination of a plurality of compounds can be used, and a single one of the at least trihydric alcohol components can be used by itself or a combination of a plurality of compounds can be used.

The amorphous polyester can be produced by an esterification reaction or transesterification reaction using the aforementioned alcohol component and carboxylic acid component. In order to accelerate the reaction, a known esterification catalyst, e.g., dibutyltin oxide, may be used as appropriate in the polycondensation.

The molar ratio between the carboxylic acid component and alcohol component (carboxylic acid component/alcohol component) that are the starting monomers for the amorphous polyester is preferably at least 0.60 and not more than 1.00.

Viewed from the standpoint of the fixing performance and heat-resistant storability, the glass transition temperature (Tg) of the amorphous polyester is preferably at least 45° C. and not more than 75° C.

The glass transition temperature (Tg) can be acquired by measurement with a differential scanning calorimeter (DSC).

The peak molecular weight (Mp) of the amorphous polyester is preferably at least 8,000 and not more than 13,000 and is more preferably at least 9,000 and not more than 12,000.

When the peak molecular weight (Mp) is at least 8,000, toner deterioration during long-term use is then readily suppressed. When, on the other hand, the peak molecular weight (Mp) is not more than 13,000, instantaneous melting can then occur during fixing and as a consequence a high adhesiveness is then readily achieved.

The softening point of the amorphous polyester is preferably at least 85° C. and not more than 105° C. and is more preferably at least 90° C. and not more than 100° C.

When the softening point is at least 85° C., the toner deterioration during long-term use is then readily suppressed. When, on the other hand, the softening point is not more than 105° C., instantaneous melting can then occur during fixing and as a consequence a high adhesiveness is then readily achieved.

In order to control the peak molecular weight and softening point of the amorphous polyester into the ranges indicated above, the amorphous polyester is preferably a polycondensate of an alcohol component and a carboxylic acid component that contains, relative to the total carboxylic acid component, at least 10 mol % and not more than 50 mol % of linear aliphatic dicarboxylic acid having at least 6 and not more than 12 carbons.

The content of the amorphous polyester, per 100 mass parts of the binder resin, is preferably at least 5 mass parts and not more than 30 mass parts and is more preferably at least 7 mass parts and not more than 20 mass parts.

When this content is at least 5 mass parts, instantaneous melting during fixing can then occur, and as a consequence a high adhesiveness is then readily achieved. When, on the other hand, this content is not more than 30 mass parts, toner deterioration during long-term use is readily suppressed.

The peak molecular weight (Mp) of the toner is preferably at least 15,000 and not more than 30,000 and is more preferably at least 20,000 and not more than 30,000.

When the peak molecular weight (Mp) of the toner is at least 15,000, toner deterioration during long-term use is then readily suppressed. When, on the other hand, the peak molecular weight (Mp) of the toner is not more than 30,000, a retardation of melting during fixing is suppressed.

In a cross section of the toner particle observed with a transmission electron microscope (TEM), preferably the vinyl resin forms a matrix and the amorphous polyester forms domains and the proportion for the amorphous polyester domains present in the region within 25% of the distance from the contour of the cross section to the centroid of the cross section is at least 30 area % and not more than 70 area % relative to the total area of the amorphous polyester domains. At least 45 area % and not more than 70 area % is more preferred.

As noted above, compared with conventional amorphous polyesters, with the aforementioned amorphous polyester the softening point is controlled downward in a state in which the peak molecular weight (Mp) is increased.

However, when this amorphous polyester forms a shell portion, the toner assumes a deteriorating trend during long-term use. Moreover, in comparison to vinyl resins, amorphous polyesters tend to more readily absorb moisture, and as a consequence a reduction in transferability and the occurrence of poor control in association with a decline in the flowability is more readily seen in high-temperature, high-humidity environments.

In contrast to this, the durability, transferability, and adhesiveness can be brought to high levels when, in a cross section of the toner particle observed with a transmission electron microscope (TEM), the vinyl resin forms a matrix and the amorphous polyester forms domains and the proportion for the amorphous polyester domains present in the region within 25% of the distance from the contour of the cross section to the centroid of the cross section is at least 30 area % and not more than 70 area % relative to the total area of the amorphous polyester domains.

Toner deterioration during long-term use is readily suppressed by having the vinyl resin form a matrix in the vicinity of the toner particle surface. Moreover, in comparison to the amorphous polyester, which has a carboxylic acid group or hydroxyl group at the bonding terminals of the resin, the vinyl resin more readily suppresses hygroscopicity and as a consequence the flowability is more readily maintained in a high-temperature, high-humidity environment and control defects and reductions in the transferability are more readily suppressed.

In addition, by having the amorphous polyester form a plurality of domains in the vicinity of the toner particle surface, instantaneous melting can then occur during fixing and fixation tailing is then readily suppressed.

Based on the preceding, instantaneous melting during fixing can occur—and fixation tailing is then readily suppressed—when the area percentage, with respect to the total area of the amorphous polyester domains, for the amorphous polyester domains present in the region within 25% of the distance from the contour of the toner particle cross section to the centroid of the cross section (also referred to herebelow as the "25% area ratio") is at least 30 area %.

When, on the other hand, this 25% area ratio is not more than 70 area %, the flowability in high-temperature, high-humidity environments is readily maintained and control defects and reductions in the transferability are then readily suppressed.

The proportion, with respect to the total area of the amorphous polyester domains, for the amorphous polyester domains present in the region within 50% of the distance from the contour of the toner particle cross section to the centroid of the cross section is preferably at least 80 area % and not more than 100 area %. At least 90 area % and not more than 100 area % is more preferred.

Instantaneous melting during fixing can occur—and fixation tailing is then readily suppressed—when the area percentage, with respect to the total area of the amorphous polyester domains, for the amorphous polyester domains present in the region within 50% of the distance from the contour of the toner particle cross section to the centroid of the cross section (also referred to herebelow as the "50% area ratio") is at least 80 area %.

This specification that the 50% area ratio is at least 80 area % can also be considered as meaning that the amorphous polyester domains are present at not more than 20 area %, with respect to the total area of the amorphous polyester domains, in the region from the "centroid of the toner particle cross section" to the "boundary line that is 50% of the distance from the contour of the toner particle cross section to the centroid of the cross section". In this case, the softening point of the toner is easily controlled to at least 110° C. and the flowability during long-term use is readily maintained and control defects and reductions in the transferability are then readily suppressed.

Moreover, the relationship in the following formula (1) is preferably satisfied by A and B where A is the area of the amorphous polyester domains present in the region within 25% of the distance from the contour of the toner cross section to the centroid of the cross section and B is the area of the amorphous polyester domains present in the region that is 25% to 50% of the distance from the contour of the cross section to the centroid of the cross section.

$$A/B \geq 1.05 \quad \text{formula (1)}$$

This [A/B] (also referred to in the following as the domain area ratio) is preferably not more than 3.00.

The relationship in the following formula (1)' is more preferably satisfied by this A and B.

$$3.00 \geq A/B \geq 1.20 \quad \text{formula (1)'}$$

When this A and B satisfy the relationship in formula (1), this indicates that the amorphous polyester domains are more skewed toward the toner particle surface. By having the amorphous polyester domains be more skewed toward the toner particle surface, instantaneous melting can then occur during fixing and the fixation tailing is then readily suppressed.

The number-average diameter of the amorphous polyester domains in a cross section of the toner particle observed with a transmission electron microscope is preferably at least 0.3 μm and not more than 3.0 μm and is more preferably at least 0.3 μm and not more than 2.0 μm.

When the number-average diameter of the amorphous polyester domains is at least 0.3 μm, f2 is then readily controlled to be at least 30 g·m/sec and the adhesiveness with the media, e.g., paper, and the toner particle-to-toner particle adhesiveness when melted during fixing are then improved and the fixation tailing is even more readily suppressed.

When, on the other hand, the number-average particle diameter of the amorphous polyester domains is not more than 3.0 μm, the state of occurrence of the amorphous polyester domains within the toner particle is then easily controlled. In addition, the toner particle-to-toner particle variability in the amorphous polyester domains can also be reduced. The fixation tailing is then more readily suppressed as a consequence.

The following are examples of measures for forming the amorphous polyester domains in the vicinity of the toner particle surface and for controlling the number-average particle diameter of the amorphous polyester domains: adjusting the acid value and hydroxyl value of the amorphous polyester; attaching an oleophilic segment in molecular chain terminal position on the amorphous polyester; adjusting the softening points of the amorphous polyester and toner; and adjusting the production conditions for the toner particle.

The acid value of the amorphous polyester is preferably at least 1.0 mg KOH/g and not more than 10.0 mg KOH/g and is more preferably at least 4.0 mg KOH/g and not more than 8.0 mg KOH/g.

The 25% area ratio is easily controlled to be at least 30 area % when the acid value of the amorphous polyester is at least 1.0 mg KOH/g.

On the other hand, the 25% area ratio is easily controlled to be not more than 70 area % when the acid value of the amorphous polyester is not more than 10.0 mg KOH/g.

The hydroxyl value of the amorphous polyester is preferably not more than 40.0 mg KOH/g and is more preferably not more than 30 mg KOH/g. In addition, the lower limit, while not being particularly limited, is preferably at least 5 mg KOH/g and is more preferably at least 10 mg KOH/g.

Formation of the amorphous polyester domains in the vicinity of the toner surface is readily brought about when the hydroxyl value of the amorphous polyester resin is not more than 40.0 mg KOH/g.

An oleophilic segment is preferably attached in molecular chain terminal position on the amorphous polyester in order to control the acid value of the amorphous polyester resin to at least 1.0 mg KOH/g and not more than 10.0 mg KOH/g and control the hydroxyl value of the amorphous polyester resin to be not more than 40.0 mg KOH/g.

The amorphous polyester preferably is a polyester that has an oleophilic segment in molecular chain terminal position.

Interaction with the vinyl resin is facilitated by having an oleophilic segment in molecular chain terminal position on the amorphous polyester, and as a consequence the size and location of occurrence of the amorphous polyester domains are then readily controlled.

An oleophilic segment may be attached in molecular chain terminal position on the amorphous polyester by reaction with a compound having an at least monovalent functional group capable of reaction with the molecular chain terminal of the amorphous polyester.

This compound having an at least monovalent functional group is preferably at least one compound selected from the group consisting of aliphatic monoalcohols having at least 10 and not more than 30 carbons and aliphatic monocarboxylic acids having at least 11 and not more than 31 carbons.

This compound can be exemplified by dodecanoic acid (lauric acid), tetradecanoic acid (myristic acid), hexadecanoic acid (palmitic acid), octadecanoic acid (stearic acid), eicosanoic acid (arachidic acid), docosanoic acid (behenic acid), tetracosanoic acid (lignoceric acid), capric alcohol, lauryl alcohol, myristyl alcohol, cetanol, stearyl alcohol, arachidyl alcohol, behenyl alcohol, and lignoceryl alcohol.

Thus, the amorphous polyester is preferably a polyester that has, in molecular chain terminal position, a structure derived from at least one compound selected from the group consisting of aliphatic monoalcohols having at least 10 and not more than 30 carbons and aliphatic monocarboxylic acids having at least 11 and not more than 31 carbons.

S85 and S211 preferably satisfy the relationship in the following formula (2) and more preferably satisfy the relationship in the following formula (2)', where S85 is the peak intensity derived from the vinyl resin and S211 is the peak intensity derived from the amorphous polyester, in each instance as obtained by time-of-flight secondary ion mass spectrometry (TOF-SIMS) on the toner.

$$0.30 \leq S211/S85 \leq 3.00 \quad \text{formula (2)}$$

$$1.00 \leq S211/S85 \leq 2.50 \quad \text{formula (2)'}$$

Time-of-flight secondary ion mass spectrometry (TOF-SIMS) can provide data for several nanometers from the toner particle surface and thus can identify the constituent materials for the surface most layer of the toner particle.

In a preferred construction the amorphous polyester has a monomer unit derived from bisphenol A as the alcohol component, and S211 is thus a peak derived from this bisphenol A.

In addition, in a preferred construction the vinyl resin is a styrene-butyl acrylate copolymer as indicated above, and S85 is thus a peak derived from this butyl acrylate.

When S211/S85 is at least 0.30, the amorphous polyester is present at the surface side of the toner particle and due to this the toner can undergo instantaneous melting during fixing and the fixation tailing is then readily suppressed.

When, on the other hand, S211/S85 is not more than 3.00, toner deterioration during long-term use is readily suppressed.

Techniques for adjusting [S211/S85] into the indicated range can be exemplified by adjusting the acid value and hydroxyl value of the amorphous polyester and adjusting the conditions for production of the toner particle.

The weight-average particle diameter (D4) of the toner is preferably at least 5.0 μm and not more than 12.0 μm and is more preferably at least 5.5 μm and not more than 11.0 μm.

When the weight-average particle diameter (D4) is in the indicated range, an excellent flowability is obtained and triboelectric charging at the control member is facilitated and as a consequence development ghosts are readily suppressed and faithful development at the latent image can be achieved.

The average circularity of the toner preferably is at least 0.950 and not more than 1.000 and is more preferably at least 0.960 and not more than 1.000.

The toner particle assumes a spherical or near-spherical shape at an average circularity for the toner of at least 0.950, and the flowability is then excellent, a uniform triboelectric charging performance is readily obtained, and control defects are readily suppressed. The transferability is also readily improved.

The glass transition temperature (Tg) of the toner is preferably at least 40.0° C. and not more than 70.0° C.

When the glass transition temperature is in the indicated range, improvements in the storage stability and durability of the toner can be brought about while maintaining an excellent fixing performance.

The glass transition temperature (Tg) can be measured using a differential scanning calorimeter (DSC).

As necessary, the toner particle may contain a charge control agent in order to enhance the charging characteristics.

While various charge control agents can be used, charge control agents that provide a fast charging speed and that can stably maintain a certain charge quantity are particularly preferred.

The charge control agent can be exemplified by the following:

metal compounds of aromatic carboxylic acids, e.g., salicylic acid, alkylsalicylic acid, dialkylsalicylic acid, naphthoic acid, and dicarboxylic acids; metal salts and metal complexes of azo dyes and azo pigments; polymer compounds having a sulfonic acid or carboxylic acid group in side chain position; boron compounds; urea compounds; silicon compounds; and calixarene.

When added to the interior of the toner particle, the content of these charge control agents, per 100 mass parts of the binder resin, is preferably at least 0.1 mass parts and not more than 10.0 mass parts and is more preferably at least 0.1 mass parts and not more than 5.0 mass parts. When added to the outside of the toner particle, and considered per 100 mass parts of the toner particle, at least 0.005 mass parts and not more than 1.000 mass parts is preferred and at least 0.010 mass parts and not more than 0.300 mass parts is more preferred.

The toner particle may contain a release agent in order to enhance the fixing performance.

The content of the release agent in the toner particle is preferably at least 1 mass % and not more than 30 mass % and is more preferably at least 3 mass % and not more than 25 mass %.

When the release agent content is at least 1 mass %, fixation tailing is then readily suppressed. When it is not more than 30 mass %, toner deterioration during long-term use is then readily suppressed.

The release agent can be exemplified by the following:

petroleum-based waxes such as paraffin wax, microcrystalline wax, and petrolatum, and derivatives thereof; montan wax and derivatives thereof; hydrocarbon waxes provided by the Fischer-Tropsch method and derivatives thereof; polyolefin waxes, e.g., polyethylene, and derivatives thereof; and natural waxes, e.g., carnauba wax and candelilla wax, and derivatives thereof.

The derivatives include the oxides and block copolymers and graft modifications with vinyl monomers. The following, for example, can also be used as the release agent: higher aliphatic alcohols, fatty acids such as stearic acid and palmitic acid, acid amide waxes, ester waxes, hardened castor oil and derivatives thereof, plant-derived waxes, and animal waxes.

Among these release agents, the use of ester waxes and paraffin waxes is preferred from the standpoint of suppressing fixation tailing.

The melting point specified by the peak temperature of the maximum endothermic peak during temperature ramp-up measurement with a differential scanning calorimeter (DSC) on these release agents is preferably at least 60° C. and not more than 140° C. and is more preferably at least 65° C. and not more than 120° C.

Suppression of toner deterioration during long-term use is readily achieved when the melting point is at least 60° C. On the other hand, a reduction in the low-temperature fixability is inhibited when the melting point is not more than 140° C.

As indicated above, the melting point of the release agent is the peak temperature of the maximum endothermic peak measured with a DSC. The peak temperature of the maximum endothermic peak is measured according to ASTM D 3417-99.

For example, a DSC-7 from PerkinElmer Inc., a DSC 2920 from TA Instruments, or a Q1000 from TA Instruments can be used for this measurement.

Temperature correction in the instrument detection section uses the melting points of indium and zinc, and the amount of heat is corrected using the heat of fusion of indium. The measurement is run using an aluminum pan for the measurement sample and installing an empty aluminum pan for reference.

The toner particle contains a colorant. In addition, this colorant preferably contains a magnetic body.

Carbon black, a magnetic body, or a black colorant provided by color mixing using yellow, magenta, and cyan colorants to give a black color can be used as the black colorant.

A single-component developing system is an effective means for downsizing a printer. Another effective means is to eliminate the feed roller that feeds the toner within the cartridge to the toner-bearing member. A magnetic single-component developing system is preferred for such a feed roller-free single-component developing system, and a magnetic toner is preferably that uses a magnetic body as the colorant for the toner. A high transportability and a high colorant performance can be achieved by using such a magnetic toner.

The magnetic body is preferably a magnetic body in which the main component is a magnetic iron oxide, e.g., triiron tetroxide or γ-iron oxide, and it may contain an element such as phosphorus, cobalt, nickel, copper, magnesium, manganese, aluminum, silicon, and so forth.

The BET specific surface area of the magnetic body by the nitrogen adsorption method is preferably at least 2.0 $m^2/g$ and not more than 20.0 $m^2/g$ and is more preferably at least 3.0 $m^2/g$ and not more than 10.0 $m^2/g$.

The shape of the magnetic body is, for example, polyhedral, octahedral, hexahedral, spherical, acicular, or scale, and a low-anisotropy magnetic body, e.g., polyhedral, octahedral, hexahedral, spherical, and so forth, is preferred from the standpoint of increasing the image density.

Viewed from the standpoint of the tint and a uniform dispersity in the toner, the number-average particle diameter of the magnetic body is preferably at least 0.10 μm and not more than 0.40 μm.

The number-average particle diameter of the magnetic body can be measured using a transmission electron microscope. Specifically, the toner to be observed is thoroughly dispersed in an epoxy resin followed by curing for 2 days in an atmosphere with a temperature of 40° C. to obtain a cured material. A thin-section sample is prepared from this cured material using a microtome, and the particle diameters of 100 magnetic bodies are measured in the field of observation of a 10,000× to 40,000× photograph using a transmission electron microscope (TEM). The number-average particle diameter is calculated based on the circle-equivalent diameters of the projected areas of the magnetic bodies. The particle diameter can also be measured with an image analyzer.

With regard to the state of occurrence of the magnetic bodies within the toner particle, preferably magnetic bodies are not exposed at the surface of the toner particle and are present in the interior from the surface. Moreover, the magnetic body content and its state of occurrence are preferably uniform from toner particle to toner particle. A toner having magnetic bodies in such a dispersed state can be produced, for example, by executing a desired hydrophobic treatment on the magnetic body and carrying out toner particle production by suspension polymerization.

The magnetic body can be produced, for example, by the following method.

First, an alkali, e.g., sodium hydroxide, is added—in an equivalent amount or more than an equivalent amount relative to the iron component—to an aqueous solution of a ferrous salt to prepare an aqueous solution containing ferrous hydroxide. Air is blown in while keeping the pH of the prepared aqueous solution at 7.0 or above, and an oxidation reaction is carried out on the ferrous hydroxide while heating the aqueous solution to at least 70° C. to produce seed crystals that will form the cores for magnetic iron oxide particles.

Then, an aqueous solution containing ferrous sulfate is added, in an amount that is approximately 1 equivalent based on the amount of addition of the previously added alkali, to the seed crystal-containing slurry. While maintaining the pH of the obtained mixture at 5.0 to 10.0 and blowing in air, the reaction of the ferrous hydroxide is developed in order to grow magnetic iron oxide particles using the seed crystals as cores. At this point, the shape and magnetic properties of the magnetic iron oxide can be controlled by free selection of the pH, reaction temperature, and stirring conditions. The pH of the mixture transitions to the acidic side as the oxidation reaction progresses, but the pH of the mixture preferably does not drop below 5.0.

After the completion of the oxidation reaction, a silicon source, e.g., sodium silicate, is added and the pH of the mixture is adjusted to at least 5.0 and not more than 8.0 and a silicon coating layer is formed on the surface of the magnetic iron oxide particles. The obtained magnetic iron oxide particles are filtered, washed, and dried by standard methods to obtain a magnetic iron oxide (magnetic body).

In addition, when the toner particle is produced in an aqueous medium, e.g., by a suspension polymerization method, a hydrophobic treatment of the magnetic body surface is preferred from the standpoint of facilitating the incorporation of the magnetic bodies within the toner particle.

When this hydrophobic treatment is carried out by a dry method, the hydrophobic treatment is carried out using a coupling agent on the washed, filtered, and dried magnetic iron oxide.

When the hydrophobic treatment is carried out by a wet method, treatment with the coupling agent is carried out with redispersion in an aqueous medium of the magnetic iron oxide obtained as above, or with redispersion, in a separate aqueous medium without drying, of the magnetic iron oxide obtained by washing and filtration as described above.

For example, a silane coupling agent or silane compound is added while thoroughly stirring the redispersion and a coupling treatment is carried out by raising the temperature after hydrolysis or by adjusting the pH of the dispersion after hydrolysis into the alkaline region.

The coupling agents and silane compounds that can be used for hydrophobic treatment of the magnetic body can be exemplified by silane coupling agents, titanium coupling agents, and silane compounds. Silane coupling agents, silane compounds, and compounds given by the following general formula (I) are preferred.

$$R_mSiY_n \qquad \text{formula (I)}$$

[In formula (I), R represents an alkoxy group or hydroxyl group; Y represents an alkyl group, phenyl group, or vinyl group wherein the alkyl group may have an amino group, hydroxy group, epoxy group, acryl group, methacryl group, and so forth as a substituent; m represents an integer from 1 to 3; and n represents an integer from 1 to 3; with the proviso that m+n=4.]

The silane coupling agents and silane compounds given by formula (I) can be exemplified by vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-propyltrimethoxysilane, isopropyltrimethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane, and n-octadecyltrimethoxysilane and the hydrolyzates of the preceding.

Y in formula (I) is preferably an alkyl group. Among these, alkyl groups having 3 to 6 carbons are preferred.

In the case of use of a silane coupling agent or a silane compound, treatment may be carried out with a single one or may be carried out using a plurality of species in combination.

When the combination of a plurality of species is used, a separate treatment may be performed with each individual silane coupling agent or silane compound or a simultaneous treatment may be carried out.

The total treatment amount with the coupling agent or silane compound is preferably at least 0.9 mass parts and not more than 3.0 mass parts per 100 mass parts of the magnetic body, and the amount thereof should be adjusted in conformity with the surface area of the magnetic body, the reactivity of the silane coupling agent or silane compound, and so forth.

Another colorant may be used in combination with this magnetic body. The colorant co-used with the magnetic body may be any of the various pigments and dyes indicated below, carbon black, and so forth.

The magnetic body content in the toner particle, per 100 mass parts of the binder resin, is preferably at least 40 mass parts and not more than 90 mass parts and more preferably at least 50 mass parts and not more than 70 mass parts.

At 40 mass parts and above, enhancement of the image density is facilitated due to a high tinting strength. On the other hand, fixation tailing is readily suppressed at not more than 90 mass parts.

The magnetic body content in the toner particle can be measured using a [TGA7] thermal analyzer from PerkinElmer Inc. The measurement method is as follows.

The toner is heated in a nitrogen atmosphere from normal temperature to 900° C. at a ramp rate of 25° C./minute. The mass loss % from 100° C. to 750° C. is taken to be the amount of the binder resin and the remaining mass is taken to be approximately the amount of the magnetic body.

Yellow colorants can be exemplified by compounds as typified by condensed azo compounds, isoindolinone compounds, anthraquinone compounds, azo metal complexes, methine compounds, and allylamide compounds.

Specific examples are C. I. Pigment Yellow 12, 13, 14, 15, 17, 62, 73, 74, 83, 93, 94, 95, 97, 109, 110, 111, 120, 128, 129, 138, 147, 150, 151, 154, 155, 168, 180, 185, and 214.

Magenta colorants can be exemplified by condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Specific examples are C. I. Pigment Red 2, 3, 5, 6, 7, 23, 48:2, 48:3, 48:4, 57:1, 81:1, 122, 146, 166, 169, 177, 184, 185, 202, 206, 220, 221, 238, 254, and 269 and C. I. Pigment Violet 19.

The cyan colorant can be exemplified by copper phthalocyanine compounds and their derivatives, anthraquinone compounds, and basic dye lake compounds.

Specific examples are C. I. Pigment Blue 1, 7, 15, 15:1, 15:2, 15:3, 15:4, 60, 62, and 66.

A single one of these colorants may be used or a mixture may be used and these colorants may also be used in a solid solution state. The colorant is selected considering the hue angle, chroma, lightness, lightfastness, OHP transparency, and dispersibility in the toner particle. The amount of addition used for the colorant is addition at 1 to 20 mass parts per 100 mass parts of the polymerizable monomer or binder resin.

The toner particle can be produced in the present invention by any known method.

Production by a pulverization method is described first.

The binder resin, amorphous polyester, and colorant and as necessary a release agent, charge control agent, and so forth are thoroughly mixed using a mixer, e.g., Henschel mixer, ball mill, and so forth. The toner particle is then obtained by carrying out melt-kneading using a heated kneader such as a hot roll, kneader, or extruder in order to disperse or dissolve the aforementioned toner materials, followed by cooling and solidification, pulverization, and then classification and as necessary the execution of a surface treatment.

With regard to the sequencing of classification and the surface treatment, either may be carried out first. Viewed from the standpoint of the production efficiency, the classification step preferably uses a multi-grade classifier.

While the toner particle can be produced by a pulverization method as described above, a method in which the toner particle is produced in an aqueous medium, e.g., a dissolution suspension method, suspension polymerization method, and so forth, is preferably used in order to bring about the formation of the amorphous polyester domains in the vicinity of the toner surface and control the number-average diameter of the amorphous polyester domains. Among the preceding, the use of the suspension polymerization method is more preferred.

In the suspension polymerization method, a polymerizable monomer composition is obtained by dissolving or dispersing the following to uniformity using a disperser: the amorphous polyester, polymerizable monomer that will produce the binder resin, and colorant and as necessary other additives such as a release agent, polymerization initiator, crosslinking agent, charge control agent, and so forth.

The disperser can be exemplified by homogenizers, ball mills, and ultrasound dispersers.

The resulting polymerizable monomer composition is then suspended in an aqueous medium that contains a dispersing agent to form particles of the polymerizable monomer composition. At this point, a sharper particle diameter is provided for the obtained toner particles to the degree that the desired toner particle size is provided all at once using a high-speed disperser such as a high-speed stirrer or an ultrasound disperser. In addition, after the particles of the polymerizable monomer composition have been formed, stirring should be carried out, using an ordinary stirrer, to a degree sufficient to maintain the particulate state and prevent flotation and sedimentation of the particles.

The toner particle is obtained by polymerizing the polymerizable monomer present in the polymerizable monomer composition particle. The polymerization temperature here may be set to a temperature of at least 40° C. and generally at least 50° C. and not more than 90° C.

With regard to the timing for the addition of the polymerization initiator, it may be added at the same time as the addition of the other additives to the polymerizable monomer or may be admixed immediately prior to suspension in the aqueous medium. In addition, the polymerization initiator may also be added prior to the start of the polymerization reaction.

The shape of the individual toner particles for the resulting toner particle is uniformly approximately spherical and as a result improvement in the flowability at control members is facilitated and triboelectric charging is facilitated, and as a consequence control defects are readily suppressed.

The polymerizable monomer can be exemplified by the following:

styrenic monomers such as styrene, o-methylstyrene, m-methylstyrene, p-methylstyrene, p-methoxystyrene, and p-ethylstyrene;

acrylate ester monomers such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate;

methacrylate ester monomers such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and monomers such as acrylonitrile, methacrylonitrile, and acrylamide.

These can be used individually or a combination of a plurality can be used.

Advantageous examples among the polymerizable monomers given above are the styrenic monomers, acrylate ester monomers, and methacrylate ester monomers.

The content of the styrenic monomer in the polymerizable monomer is preferably at least 60 mass % and not more than 90 mass % and is more preferably at least 65 mass % and not more than 85 mass %. On the other hand, the content of acrylate ester monomer or methacrylate ester monomer is preferably at least 10 mass % and not more than 40 mass % and is more preferably at least 15 mass % and not more than 35 mass %.

The use of a combination of styrene and n-butyl acrylate is more preferred because this facilitates a reduction in the hygroscopicity and facilitates an enhancement in the transferability in high-temperature, high-humidity environments.

The polymerizable monomer composition may contain a polar resin.

Since toner particle production is carried out in an aqueous medium in the suspension polymerization method, the incorporation of a polar resin can result in the disposition of the polar resin at the toner particle surface, which facilitates improvements in the charging performance and facilitates suppression of development ghosts.

The polar resin can be exemplified by the following:

homopolymers of styrene and its substituted forms, e.g., polystyrene and polyvinyltoluene;

styrene copolymers such as styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-dimethylaminoethyl acrylate copolymers, styrene-methyl methacrylate copolymers, styrene-ethyl methacrylate copolymers, styrene-butyl methacrylate copolymers, styrene-dimethylaminoethyl methacrylate copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-maleic acid copolymers, and styrene-maleate ester copolymers; as well as polymethyl methacrylate, polybutyl methacrylate, polyvinyl acetate, polyethylene, polypropylene, polyvinyl butyral, silicone resins, polyamide resins, epoxy resins, polyacrylic acid resins, terpene resins, and phenolic resins.

A single one of these may be used or a combination of a plurality may be used. In addition, a functional group, e.g., amino group, carboxy group, hydroxyl group, sulfonic acid group, glycidyl group, nitrile group, and so forth, may be introduced into these polymers.

The polymerization initiator preferably has a half-life in the polymerization reaction of at least 0.5 hours and not more than 30.0 hours. In addition, a desirable strength and suitable melting characteristics can be imparted to the toner particle when the polymerization reaction is carried out using an amount of addition of at least 0.5 mass parts and not more than 20.0 mass parts per 100 mass parts of the polymerizable monomer.

Specific examples are as follows: azo and diazo polymerization initiators such as 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile, and peroxide polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butyl peroxy-2-ethylhexanoate, and tert-butyl peroxypivalate.

Primarily compounds having at least two polymerizable double bonds may be used for the aforementioned crosslinking agent. Examples are aromatic divinyl compounds such as divinylbenzene and divinylnaphthalene; carboxylate esters having two double bonds such as, for example, ethylene glycol diacrylate, ethylene glycol dimethacrylate, and 1,3-butanediol dimethacrylate; and divinyl compounds such as divinylaniline, divinyl ether, divinyl sulfide, and divinyl sulfone. A single one of these may be used by itself or a mixture of two or more may be used.

The amount of addition of the crosslinking agent is preferably at least 0.01 mass parts and not more than 5.00 mass parts per 100 mass parts of the polymerizable monomer.

A surfactant, organic dispersing agent, or inorganic dispersing agent can be used as the aforementioned dispersion stabilizer.

The inorganic dispersing agent can be exemplified by multivalent metal salts of phosphoric acid, such as tricalcium phosphate, magnesium phosphate, aluminum phosphate, zinc phosphate, and hydroxyapatite; carbonates such as calcium carbonate and magnesium carbonate; inorganic salts such as calcium metasilicate, calcium sulfate, and barium sulfate; and inorganic compounds such as calcium hydroxide, magnesium hydroxide, and aluminum hydroxide.

The amount of addition of the dispersing agent is preferably at least 0.2 mass parts and not more than 20.0 mass parts per 100 mass parts of the polymerizable monomer. A single one of these dispersing agents may be used by itself or a plurality may be used in combination.

The following steps are preferably executed in order to bring about formation of the amorphous polyester domains in the vicinity of the toner particle surface and in order to control the number-average diameter of the amorphous polyester domains.

After resin particles have been obtained upon completion of the polymerization of the polymerizable monomer, the dispersion of the resin particles dispersed in the aqueous medium preferably is heated to around the softening point of the amorphous polyester (for example, the softening point of the amorphous polyester to this softening point+10° C.) and specifically to about 100° C. and is held at this temperature for at least 30 minutes.

This holding time is more preferably at least 60 minutes and is even more preferably at least 120 minutes. The upper limit on the holding time is about not more than 24 hours in view of the relationship to the production efficiency.

The dispersion is subsequently preferably cooled to equal to or less than the glass transition temperature (Tg) of the resin particles at a cooling rate of at least 5° C./minute and more preferably is cooled at a cooling rate of at least 20° C./minute and even more preferably is cooled at a cooling rate of at least 100° C./minute. The upper limit on this cooling rate is about not more than 500° C./minute in view of the relationship to the production efficiency.

In addition, after cooling at the aforementioned cooling rate, preferably holding is carried out at this temperature for at least 30 minutes. The holding time is more preferably at least 60 minutes and is even more preferably at least 120 minutes. The upper limit on this holding time is about not more than 24 hours in view of the relationship to the production efficiency.

The resin particles obtained by proceeding through the steps described above are filtered, washed, and dried to obtain toner particles. The toner can be obtained by, as necessary, mixing these toner particles with inorganic fine particles and attaching same to the toner particle surface.

In addition, the coarse particles and fines present in the toner particles may also be removed by the introduction of a classification step into the production process (prior to mixing with the inorganic fine particles).

When inorganic fine particles are used in order to improve the toner flowability and provide uniform charging, the number-average primary particle diameter of the inorganic fine particles is preferably at least nm and less than 80 nm and is more preferably at least 6 nm and not more than 40 nm.

Measurement of the number-average primary particle diameter of the inorganic fine particles may be carried out using photographs of the toner enlarged and taken with a scanning electron microscope.

The content of the inorganic fine particles preferably is 0.1 to 3.0 mass parts per 100 mass parts of the toner particle. The content of the inorganic fine particles can be quantitated using X-ray fluorescence analysis using a calibration curve constructed from standard samples.

The inorganic fine particles can be exemplified by fine particles such as silica fine particles, titanium oxide fine particles, alumina fine particles, and so forth. The silica fine particles can be exemplified by dry silicas, referred to as so-called dry-method or fumed silica, produced by the vapor-phase oxidation of silicon halide, and by so-called wet silica produced from, e.g., water glass.

Dry silica, which has little silanol group at the surface or in the interior of the silica fine particle and which contains little production residues such as $Na_2O$ and $SO_3^{2-}$, is preferred. In addition, composite fine particles of silica and another metal oxide can also be obtained by the use in the production process of a silicon halide compound in combination with another metal halide compound, for example, aluminum chloride or titanium chloride, and these are also encompassed by dry silica.

The inorganic fine particles are more preferably subjected to a hydrophobic treatment from the standpoint of adjusting the quantity of charge on the toner and improving the environmental stability.

The treatment agent used in this hydrophobic treatment can be exemplified by silicone varnishes, various modified silicone varnishes, silicone oils, various modified silicone oils, silane compounds, and silane coupling agents. A single one of these may be used by itself or a combination of a plurality of species may be used.

Among these treatment agents, treatment with a silicone oil is preferred, while treatment of the inorganic fine particles with a silicone oil after or at the same time as a hydrophobic treatment with a silane compound is more preferred. In this treatment method, a silylation reaction with the silane compound is carried out in a first-stage reaction in order to extinguish the silanol group by chemical bonding and then, in a second-stage reaction, a hydrophobic thin film is formed on the surface using the silicone oil.

This silicone oil has a viscosity at 25° C. preferably of at least 10 $mm^2/s$ and not more than 200,000 $mm^2/s$ and more preferably at least 3,000 $mm^2/s$ and not more than 80,000 $mm^2/s$.

The silicone oil can be specifically exemplified by dimethylsilicone oils, methylphenylsilicone oils, α-methylstyrene-modified silicone oils, chlorophenylsilicone oils, and fluorine-modified silicone oils.

The specific method for treating with silicone oil can be exemplified by methods in which the silicone oil is directly mixed with the silane compound-treated inorganic fine particles using a mixer such as a Henschel mixer and methods in which the silicone oil is sprayed on the inorganic fine particles.

Or, this may be a method in which the silicone oil is dissolved or dispersed in a suitable solvent; the inorganic fine particles are then added with mixing; and the solvent is removed. Spraying methods are more preferred because they result in relatively little production of aggregates of the inorganic fine particles.

The amount of treatment with the silicone oil, expressed per 100 mass parts of the inorganic fine particles, is preferably 1 to 40 mass parts and is more preferably 3 to 35 mass parts.

The specific surface area of the hydrophobically treated inorganic fine particles, as measured by the BET method using nitrogen adsorption, is preferably 20 to 350 $m^2/g$ and more preferably 25 to 300 $m^2/g$.

The specific surface area is determined by the BET method using a BET multipoint method by adsorption of nitrogen gas on the sample surface using an Autosorb 1 specific surface area measurement instrument (Yuasa Ionics Inc.).

Small amounts of other additives may also be used in addition to the aforementioned inorganic fine particles.

Examples here are lubricant particles such as fluororesin particles, zinc stearate particles, and polyvinylidene fluoride particles; abrasives such as cerium oxide particles, silicon carbide particles, and strontium titanate particles; anticaking agents; and opposite polarity organic fine particles or inorganic fine particles. These additives may also be used after having been subjected to a hydrophobic treatment.

The developing apparatus of the present invention is a developing apparatus that is provided with a toner that develops an electrostatic latent image formed on an electrostatic latent image-bearing member, and a toner bearing member that carries the toner and transports the toner to the electrostatic latent image bearing member, wherein the toner is the toner of the present invention.

In addition, the image forming apparatus of the present invention is an image-forming apparatus that has an electrostatic latent image bearing member, a charging member that charges the electrostatic latent image bearing member, a toner that develops an electrostatic latent image formed on the electrostatic latent image bearing member, and a toner bearing member that contacts the electrostatic latent image bearing member and transports toner, and that, via the toner bearing member, recovers toner remaining on the electrostatic latent image bearing member after transfer, wherein the toner is the toner of the present invention.

A developing apparatus and an image forming apparatus will be described in detail with reference to the figures.

Figure 2:
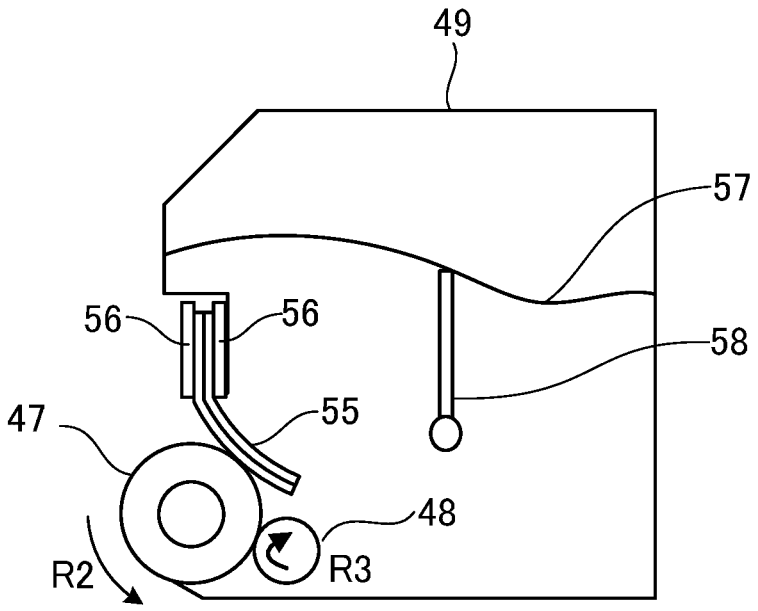
FIG. 2 is a schematic cross-sectional diagram that shows an example of a developing apparatus.
Figure 3:
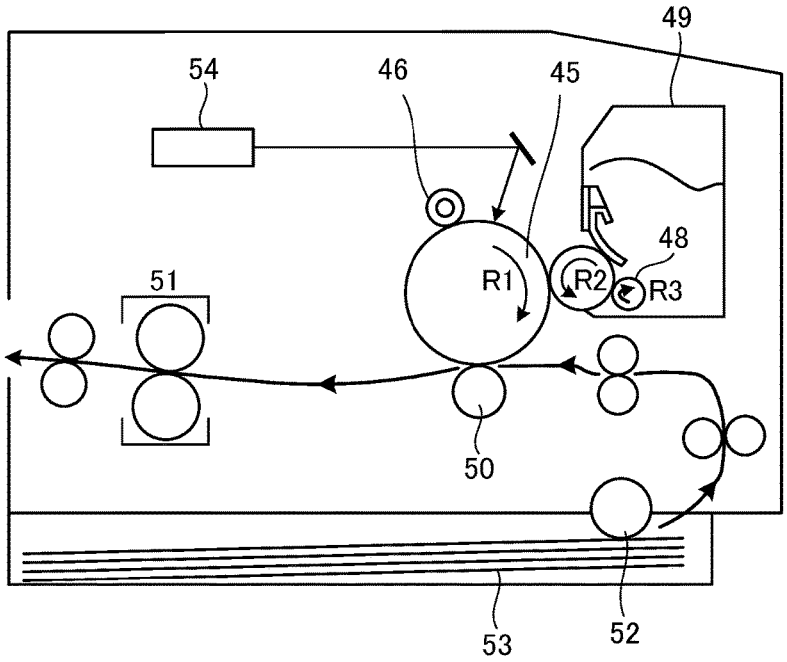
FIG. 3 is a schematic cross-sectional diagram that shows an example of an image forming apparatus.

FIG. 2 is a schematic cross-sectional diagram that shows an example of a developing apparatus. FIG. 3 is a schematic cross-sectional diagram that shows an example of an image forming apparatus that incorporates a developing apparatus.

In FIG. 2 or FIG. 3, an electrostatic latent image bearing member 45 is rotated in the direction of the arrow R1. A toner bearing member 47, through its rotation in the direction of the arrow R2, transports toner 57 into a developing zone where the toner bearing member 47 and the electrostatic latent image bearing member 45 are facing each other. In addition, a toner feed member 48 is in contact with the toner bearing member, and, through its rotation in the direction of the arrow R3, feeds toner 57 to the surface of the toner bearing member. In addition, the toner 57 is stirred by the stirring member 58.

The following, inter alia, are disposed on the circumference of the electrostatic latent image bearing member 45: a charging member (charging roller) 46, a transfer member (transfer roller) 50, a fixing unit 51, and a pick-up roller 52. The electrostatic latent image bearing member 45 is charged by the charging roller 46. Photoexposure is carried out by irradiating the electrostatic latent image bearing member 45 with laser light from a laser generating apparatus 54, thereby forming an electrostatic latent image corresponding to the intended image. The electrostatic latent image on the electrostatic latent image bearing member 45 is developed by the toner within a developing device 49 to obtain a toner image. The toner image is transferred onto a transfer material (paper) 53 by the transfer member (transfer roller) 50, which is in contact with the electrostatic latent image bearing member 45 with the transfer material interposed therebetween. The transfer material (paper) 53 carrying the toner image is forwarded to the fixing unit 51 and is fixed onto the transfer material (paper) 53.

When a cleanerless system is used, a cleaning blade, which is used to remove untransferred toner on the electrostatic latent image bearing member, is not disposed downstream from the transfer member and upstream from the charging roller, and the toner remaining post-transfer on the electrostatic latent image bearing member is recovered by the toner bearing member.

The charging step for the image forming apparatus preferably uses a contact charging device whereby the electrostatic latent image bearing member and the charging roller form an abutting region and are in contact with each other and a prescribed charging bias is applied to the charging roller to charge the surface of the electrostatic latent image bearing member to a prescribed polarity and potential. The implementation of such a contact charging enables a stable and uniform charging to be carried out and makes it possible to reduce the production of ozone.

In order to maintain a uniform contact with the electrostatic latent image bearing member and carry out uniform charging, the use is more preferred of a charging roller that rotates in the same direction as the electrostatic latent image bearing member.

Preferably the thickness of the toner layer on the toner bearing member is controlled through a toner control member (reference number 55 in FIG. 2) that abuts the toner bearing member with the toner interposed therebetween. A high image quality free of control defects can be obtained by doing this. A control blade is generally used as the toner control member abutting the toner bearing member, and this can also be suitably used in the present invention.

The base that is the upper side of the control blade is fixed to and held by the developing apparatus, and the lower side is brought into contact with the surface of the toner bearing member while exercising a suitable elastic pressing force, in a bent state in which it is flexed against the elastic force of the blade and in the forward direction or reverse direction of the toner bearing member.

For example, as shown in FIG. 2, fixing of the toner control member 55 to the developing apparatus may be carried out by sandwiching a free end of the toner control member 55 between two fixing members (for example, a metal elastic body, reference number 56 in FIG. 2) and fixing with bolts.

The outer diameter of the toner bearing member is preferably 8.0 to 14.0 mm in order for downsizing to coexist with toner ghost suppression.

The developing step is preferably a step in which a toner image is formed by applying a developing bias to the toner bearing member and thereby transferring the toner to the electrostatic latent image on the electrostatic latent image bearing member. The applied developing bias may be a direct current voltage or a voltage obtained by superimposing an alternating electric field on a direct current voltage.

Figure 4:
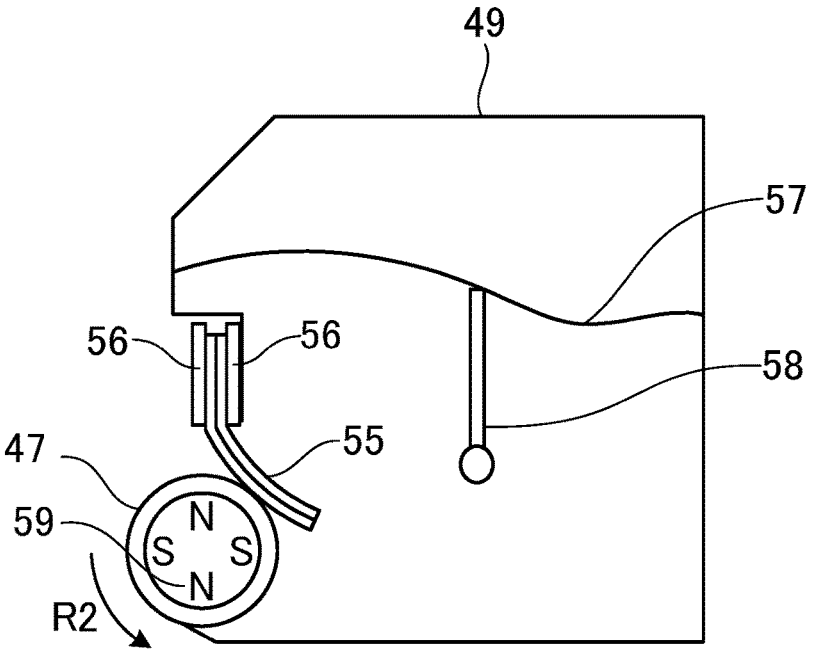
FIG. 4 is a schematic cross-sectional diagram that shows another example of a developing apparatus.

When a method is used in which the toner is transported magnetically without using a toner feed member, a magnet may be disposed in the interior of the toner bearing member (reference number 59 in FIG. 4). In this case, the toner bearing member preferably has a multipole fixed magnetic in its interior. Preferably 3 to 10 magnetic poles are present.

The methods used to measure the various properties referenced by the present invention are described in the following.

<Method for Measuring the Softening Point of the Toner and the Amorphous Polyester>

Measurement of the softening point of the toner and amorphous polyester is carried out using a "Flowtester CFT-500D Flow Property Evaluation Instrument" (Shimadzu Corporation), which is a constant-load extrusion-type capillary rheometer, according to the manual provided with the instrument.

With this instrument, while a constant load is applied by a piston from the top of the measurement sample, the measurement sample filled in a cylinder is heated and melted and the melted measurement sample is extruded from a die at the bottom of the cylinder; a flow curve showing the relationship between piston stroke and temperature can be obtained from this.

The "melting temperature by the ½ method", as described in the manual provided with the "Flowtester CFT-500D Flow Property Evaluation Instrument", is used as the softening point in the present invention. The melting temperature by the ½ method is determined as follows.

Figure 5:
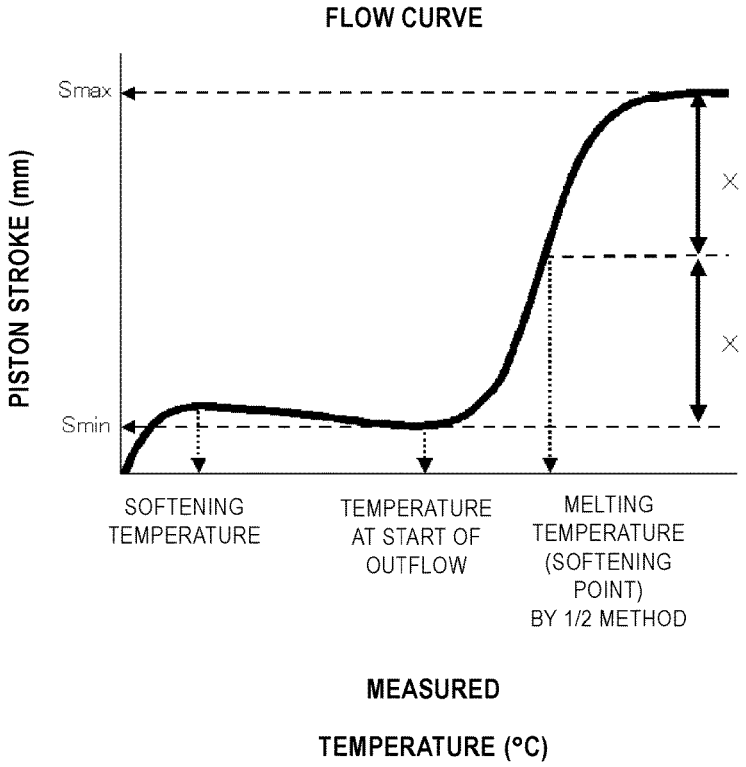
FIG. 5 is a model diagram of a flow curve.

First, ½ of the difference between Smax, which is the piston stroke at the completion of outflow, and Smin, which is the piston stroke at the start of outflow, is determined (this value is designated as X, where X=(Smax−Smin)/2). The temperature of the flow curve when the piston stroke in the flow curve reaches the sum of X and Smin is the melting temperature by the ½ method (a model diagram of the flow curve is given in FIG. 5).

The measurement sample used is prepared by subjecting approximately 1.0 g of the toner or amorphous polyester to compression molding for approximately 60 seconds at approximately 10 MPa in a 25° C. environment using a tablet compression molder (for example, NT-100H, NPa System Co., Ltd.) to provide a cylindrical shape with a diameter of approximately 8 mm.

The measurement conditions with the CFT-500D are as follows.

test mode: rising temperature method
start temperature: 50° C.
saturated temperature: 200° C.
measurement interval: 1.0° C.
ramp rate: 4.0° C./min
piston cross section area: 1.000 $cm^2$
test load (piston load): 10.0 kgf (0.9807 MPa)
preheating time: 300 seconds diameter of die orifice: 1.0 mm
die length: 1.0 mm <Method for Measuring the Integrated Values (f1 and f2) for the Stress for the Toner Using a Tack Tester>

(1) Production of the Toner Pellet

Approximately 3 g of the toner is introduced into a vinyl chloride measurement ring having an inner diameter of 27 mm, and a toner pellet is then produced by molding a sample by the application of 200 kN of pressure for 60 seconds using a sample press molder from Maekawa Testing Machine Mfg. Co., Ltd.

(2) Measurement of the Integrated Value of the Stress

The integrated value for the stress for the toner is measured using a "TAC-1000" tack tester (Rhesca Co., Ltd.) using the operating manual provided with the instrument.

A schematic diagram of this tack tester is given in FIG. 1. The probe end 203 has a contact surface diameter of 5 mm, and a stainless steel (SUS) material probe supplied with the instrument is used.

In the specific measurement method, the toner pellet 204 is mounted on the sample platen 205 and the probe end 203 is brought to 150° C. using a probe unit 202.

By adjusting the head part 200, the probe end 203 is then lowered until just before the probe end 203 can apply pressure to the toner pellet 204.

Pressure is then applied to the toner pellet 204 using the following conditions, and the stress value when the probe end 203 is pulled up is detected by the load sensor 201.

| | |
|---|---|
| pressing rate: | 5 mm/sec |
| press load: | 19.7 kg · m/sec |
| press holding time: | 10 msec (f1) and 100 msec (f2) |
| pull-up rate: | 15 mm/sec |

The integrated value for the stress is determined by integrating the stress value detected by the load sensor.

Specifically, the determination is performed by integrating the stress value over time from the point at the instant of the application of the force that pulls the load sensor from the toner pellet (point at which the stress value is 0 g·m/sec) to the point at which the load sensor is separated from the toner pellet.

<Method for Measuring the Weight-Average Particle Diameter (D4) of the Toner>

Using a "Coulter Counter Multisizer 3" (registered trademark, Beckman Coulter, Inc.), a precision particle size distribution measurement instrument operating on the pore electrical resistance method and equipped with a 100 μm aperture tube, and the accompanying dedicated software, i.e., "Beckman Coulter Multisizer 3 Version 3.51" (Beckman Coulter, Inc.), for setting the measurement conditions and analyzing the measurement data, the weight-average particle diameter (D4) of the toner is determined by performing the measurement in 25,000 channels for the number of effective measurement channels and analyzing the measurement data.

The aqueous electrolyte solution used for the measurements is prepared by dissolving special-grade sodium chloride in deionized water to provide a concentration of approximately 1 mass % and, for example, "ISOTON II" (Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the threshold value/noise level measurement button. In addition, the current is set to 1600 μA; the gain is set to 2; the electrolyte is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations/second. Contamination and air bubbles within the aperture tube are preliminarily removed by the "aperture flush" function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

(3) A prescribed amount of deionized water is introduced into the water tank of an "Ultrasonic Dispersion System Tetora 150" (Nikkaki Bios Co., Ltd.), which is an ultrasound disperser with an electrical output of 120 W and equipped with two oscillators (oscillation frequency=50 kHz) disposed such that the phases are displaced by 180°, and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be at least 10° C. and not more than 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4).

<Method for Measuring the Average Circularity of the Toner>

The average circularity of the toner is measured using an "FPIA-3000" (Sysmex Corporation), a flow-type particle image analyzer, and using the measurement and analysis conditions from the calibration process.

The specific measurement method is as follows.

First, approximately 20 mL of deionized water from which solid impurities and so forth have been preliminarily removed, is introduced into a glass container. To this is added as dispersing agent approximately 0.2 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

Approximately 0.02 g of the measurement sample is added and a dispersion treatment is carried out for 2 minutes using an ultrasound disperser to provide a dispersion to be used for the measurement. Cooling is carried out as appropriate during this process in order to have the temperature of the dispersion be at least 10° C. and not more than 40° C.

Using a benchtop ultrasound cleaner/disperser that has an oscillation frequency of 50 kHz and an electrical output of 150 W (for example, the "VS-150" (Velvo-Clear Co., Ltd.)) as the ultrasound disperser, a prescribed amount of deionized water is introduced into the water tank and approximately 2 mL of Contaminon N is added to the water tank.

The previously cited flow particle image analyzer fitted with a "LUCPLFLN" objective lens (20×, numerical aperture: 0.40) is used for the measurement, and "PSE-900A" (Sysmex Corporation) particle sheath is used for the sheath solution.

The dispersion prepared according to the procedure described above is introduced into the flow particle image analyzer and 2,000 of the toner are measured according to total count mode in HPF measurement mode. The average circularity of the toner is determined with the binarization threshold value during particle analysis set at 85% and with the analyzed particle diameter limited to a circle-equivalent diameter of at least 1.977 μm and less than 39.54 μm.

For this measurement, automatic focal point adjustment is performed prior to the start of the measurement using reference latex particles (for example, a dilution with deionized water of "RESEARCH AND TEST PARTICLES Latex Microsphere Suspensions 5100A", Duke Scientific). After this, focal point adjustment is preferably performed every two hours after the start of measurement.

The flow-type particle image analyzer used in the measurements had been calibrated by the Sysmex Corporation and had been issued a calibration certificate by the Sysmex Corporation. The measurements are carried out under the same measurement and analysis conditions as when the calibration certification was received, with the exception that the analyzed particle diameter is limited to a circle-equivalent diameter of at least 1.977 μm and less than 39.54 μm.

<Method for Measuring the Peak Molecular Weight Mp(T) for the Toner and the Peak Molecular Weight Mp(P) of the Amorphous Polyester>

The molecular weight distribution of the toner and amorphous polyester is measured as follows using gel permeation chromatography (GPC).

First, the sample is dissolved in tetrahydrofuran (THF) over 24 hours at room temperature. The obtained solution is filtered across a "Sample Pretreatment Cartridge" solvent-resistant membrane filter with a pore diameter of 0.2 μm (Tosoh Corporation) to obtain the sample solution. The sample solution is adjusted to a THF-soluble component concentration of approximately 0.8 mass %. The measurement is performed under the following conditions using this sample solution.

instrument: HLC8120 GPC (detector: RI) (Tosoh Corporation)
columns: 7-column train of Shodex KF-801, 802, 803, 804, 805, 806, and 807 (Showa Denko K.K.)
eluent: tetrahydrofuran (THF)
flow rate: 1.0 mL/min
oven temperature: 40.0° C.
sample injection amount: 0.10 mL A molecular weight calibration curve constructed using polystyrene resin standards (product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

<Method for Measuring the 25% Area Ratio, the 50% Area Ratio, and the Domain Area Ratio ([A]/[B] Above)>

(25% Area Ratio)

The toner is thoroughly dispersed in a visible light-curable resin (product name: Aronix LCR Series D-800, Toagosei Co., Ltd.) followed by curing by exposure to short-wavelength light. The resulting cured material is sectioned using an ultramicrotome equipped with a diamond knife to prepare 250-nm thin-section samples. Observation of the toner particle cross section is then carried out using the sectioned samples and a transmission electron microscope (JEM-2800 electron microscope, JEOL Ltd.) (TEM-EDX) at a magnification of 40,000× to 50,000× and element mapping is carried out by EDX.

The toner particle cross sections for observation are selected as follows. First, the cross-sectional area of a toner particle is determined from the toner particle cross-sectional image, and the diameter of the circle having an area equal to this cross-sectional area (the circle-equivalent diameter) is determined. Observation is performed only with toner particle cross-sectional images for which the absolute value of the difference between this circle-equivalent diameter and the weight-average particle diameter (D4) of the toner is within 1.0 μm.

The mapping conditions are a save rate of 9,000 to 13,000 and a number of integrations of 120 times.

In each particular resin-derived domain confirmed from the observed image, the spectral intensity originating with the element C and the spectral intensity originating with the element O are measured, and the amorphous polyester domains are those domains for which the spectral intensity of the element C with respect to the element O is at least 0.05.

After the identification of the amorphous polyester domains, using binarization processing the area ratio (area %) is calculated—with respect to the total area of the amorphous polyester domains present in the toner particle cross section—for the amorphous polyester domains present in the region within 25% of the distance from the contour of the toner particle cross section to the centroid of the cross section. Image Pro PLUS (Nippon Roper K.K.) is used for the binarization processing.

The calculation method is as follows. The contour and centroid of the toner particle cross section are determined using the aforementioned TEM image. The contour of the toner particle cross section is taken to be the contour along the toner particle surface observed in the TEM image.

A line is drawn from the obtained centroid to a point on the contour of the toner particle cross section. The location on this line that is 25%, from the contour, of the distance between the contour and the centroid of the cross section is identified.

This operation is carried out on the contour of the toner particle cross section for one time around, thus specifying the boundary line for 25% of the distance from the contour of the toner particle cross section to the centroid of the cross section.

Based on this TEM image in which the 25% boundary line has been identified, the area of the amorphous polyester domains present in the region bounded by the toner particle cross section contour and the 25% boundary line is measured. The total area of the amorphous polyester domains present in the toner particle cross section is also measured, and the area % is calculated relative to this total area.

(50% Area Ratio)

Proceeding as for the measurement of the 25% area ratio described above, the boundary line is identified that is 50% of the distance from the contour of the toner particle cross section to the centroid of the cross section. The area of the amorphous polyester domains present in the region bounded by the toner particle cross section contour and the 50% boundary line is measured, and the area % is calculated with reference to the total area of the domains.

(Domain Area Ratio)

Using the calculated values obtained as described above, the following formula is used to obtain the ratio (the domain area ratio: [A/B]) between the area (i.e., the [A] referenced above) of the amorphous polyester domains present in the region within 25% of the distance from the contour of the toner particle cross section to the centroid of the cross section, and the area (i.e., the [B] referenced above) of the amorphous polyester domains present in the region that is 25% to 50% of the distance from the contour of the toner particle cross section to the centroid of the cross section.

domain area ratio (i.e., [*A*/*B*])=(25% area ratio (area %))/[(50% area ratio (area %))−(25% area ratio (area %))]

<Method for Measuring the Number-Average Diameter of the Amorphous Polyester Domains>

The amorphous polyester domains are identified by carrying out element mapping using EDX as described above.

The number-average diameter of the amorphous polyester domains is obtained by determining the circle-equivalent diameter from the domain area. 100 measurements are carried out, and the arithmetic average value of the circle-equivalent diameters of 100 domains is used as the number-average diameter of the amorphous polyester domains. The toner used for calculation of this number-average diameter is selected as follows.

First, the toner particle cross-sectional area is determined from the image of the toner particle cross section, and the diameter of the circle having the same area as this cross-sectional area is determined (circle-equivalent diameter). The calculation of the number-average diameter is carried out only with toner particle cross-sectional images for which the absolute value of the difference between this circle-equivalent diameter and the weight-average particle diameter (D4) of the toner is within 1.0 μm.

<Method for Measuring the Acid Value of the Amorphous Polyester>

The acid value is the number of milligrams of potassium hydroxide required to neutralize the acid present in 1 g of a sample. The acid value of the amorphous polyester is measured in accordance with JIS K 0070-1992, and in specific terms it is measured according to the following procedure.

(1) Reagent Preparation

A phenolphthalein solution is obtained by dissolving 1.0 g of phenolphthalein in 90 mL of ethyl alcohol (95 volume %) and bringing to 100 mL by the addition of deionized water.

7 g of special-grade potassium hydroxide is dissolved in 5 mL of water and this is brought to 1 L by the addition of ethyl alcohol (95 volume %). This is introduced into an alkali-resistant container avoiding contact with, for example, carbon dioxide, and allowed to stand for 3 days, after which time filtration is carried out to obtain a potassium hydroxide solution. The obtained potassium hydroxide solution is stored in an alkali-resistant container. The factor for this potassium hydroxide solution is determined from the amount of the potassium hydroxide solution required for neutralization when 25 mL of 0.1 mol/L hydrochloric acid is introduced into an Erlenmeyer flask, several drops of the aforementioned phenolphthalein solution are added, and titration is performed using the potassium hydroxide solution. The 0.1 mol/L hydrochloric acid used is prepared in accordance with JIS K 8001-1998.

(2) Procedure (A) Main Test 2.0 g of a sample of the pulverized amorphous polyester is exactly weighed into a 200-mL Erlenmeyer flask and 100 mL of a toluene/ethanol (2:1) mixed solution is added and dissolution is carried out over 5 hours. Several drops of the aforementioned phenolphthalein solution are added as indicator and titration is performed using the aforementioned potassium hydroxide solution. The titration endpoint is taken to be persistence of the faint pink color of the indicator for approximately 30 seconds.

(B) Blank Test

The same titration as in the above procedure is run, but without using the sample (that is, with only the toluene/ethanol (2:1) mixed solution).

(3) The Acid Value is Calculated by Substituting the Obtained Results into the Following Formula.

$$A=[(C-B)\times f\times 5.61]/S$$

Here, A: acid value (mg KOH/g); B: amount (mL) of addition of the potassium hydroxide solution in the blank test; C: amount (mL) of addition of the potassium hydroxide solution in the main test; f: factor for the potassium hydroxide solution; and S: sample (g).

<Method for Measuring the Hydroxyl Value of the Amorphous Polyester>

The hydroxyl value is the number of milligrams of potassium hydroxide required to neutralize the acetic acid bonded with the hydroxyl group when 1 g of the sample is acetylated. The hydroxyl value of the amorphous polyester is measured based on JIS K 0070-1992 and in specific terms is measured according to the following procedure.

(1) Reagent Preparation 25 g of special-grade acetic anhydride is introduced into a 100-mL volumetric flask; the total volume is brought to 100 mL by the addition of pyridine; and thorough shaking then provides the acetylation reagent. The obtained acetylation reagent is stored in a brown bottle isolated from contact with, e.g., humidity, carbon dioxide, and so forth.

A phenolphthalein solution is obtained by dissolving 1.0 g of phenolphthalein in 90 mL of ethyl alcohol (95 volume %) and bringing to 100 mL by the addition of deionized water.

35 g of special-grade potassium hydroxide is dissolved in 20 mL of water and this is brought to 1 L by the addition of ethyl alcohol (95 volume %). After standing for 3 days in an alkali-resistant container isolated from contact with, e.g., carbon dioxide, filtration is performed to obtain a potassium hydroxide solution. The obtained potassium hydroxide solution is stored in an alkali-resistant container. The factor for this potassium hydroxide solution is determined as follows: 25 mL of 0.5 mol/L hydrochloric acid is taken to an Erlenmeyer flask; several drops of the above-described phenolphthalein solution are added; titration is performed with the potassium hydroxide solution; and the factor is determined from the amount of the potassium hydroxide solution required for neutralization. The 0.5 mol/L hydrochloric acid used is prepared in accordance with JIS K 8001-1998.

(2) Procedure (A) Main Test 1.0 g of the pulverized amorphous polyester sample is exactly weighed into a 200-mL roundbottom flask and exactly 5.0 mL of the above-described acetylation reagent is added from a whole pipette. When the sample is difficult to dissolve in the acetylation reagent, dissolution is carried out by the addition of a small amount of special-grade toluene.

A small funnel is mounted in the mouth of the flask and heating is then carried out by immersing about 1 cm of the bottom of the flask in a glycerol bath at approximately 97° C. In order at this point to prevent the temperature at the neck of the flask from rising due to the heat from the bath, thick paper in which a round hole has been made is preferably mounted at the base of the neck of the flask.

After 1 hour, the flask is taken off the glycerol bath and allowed to cool. After cooling, the acetic anhydride is hydrolyzed by adding 1 mL of water from the funnel and shaking. In order to accomplish complete hydrolysis, the flask is again heated for 10 minutes on the glycerol bath. After cooling, the funnel and flask walls are washed with 5 mL of ethyl alcohol.

Several drops of the above-described phenolphthalein solution are added as the indicator and titration is performed using the above-described potassium hydroxide solution. The endpoint for the titration is taken to be the point at which the pale pink color of the indicator persists for approximately 30 seconds.

(B) Blank Test

Titration is performed using the same procedure as described above, but without using the amorphous polyester sample.

(3) The Hydroxyl Value is Calculated by Substituting the Obtained Results into the Following Formula.

$$A=[\{(B-C)\times 28.05\times f\}/S]+D$$

Here, A: the hydroxyl value (mg KOH/g); B: the amount of addition (mL) of the potassium hydroxide solution in the blank test; C: the amount of addition (mL) of the potassium hydroxide solution in the main test; f: the factor for the potassium hydroxide solution; S: the sample (g); and D: the acid value (mg KOH/g) of the amorphous polyester.

<Method for Measuring the Intensity Ratio (S211/S85) of the Peak Intensity Originating with the Amorphous Polyester (S211) to the Peak Intensity Originating with the Vinyl Resin (S85) Using Time-of-Flight Secondary Ion Mass Spectrometry (TOF-SIMS)>

A TRIFT-IV from ULVAC-PHI Incorporated is used for measurement by TOF-SIMS of the intensity ratio (S211/S85) of the peak intensity originating with the amorphous polyester (S211) to the peak intensity originating with the vinyl resin (S85).

The analytic conditions are as follows.

| | |
|---|---|
| sample preparation: | toner attachment to indium sheet |
| sample pretreatment: | none |
| primary ion: | Au ion |
| acceleration voltage: | 30 kV |
| charge neutralization mode: | On |
| measurement mode: | Negative |
| raster: | 100 μm |

Calculation of the peak intensity (S85) originating with the vinyl resin: the total count number for mass numbers 84.5 to 85.5 according to the standard software (Win Cadense) from ULVAC-PHI Incorporated is used for the peak intensity (S85).

Calculation of the peak intensity (S211) originating with the amorphous polyester: the total count number for mass numbers 210.5 to 211.5 according to the standard software (Win Cadense) from ULVAC-PHI Incorporated is used for the peak intensity (S211).

Calculation of the intensity ratio (S211/S85): the intensity ratio (S211/S85) is calculated using the S85 and S211 calculated as above.

EXAMPLES

The present invention is described in additional detail through the examples provided below, but the present invention is in no way limited to or by these. Unless specifically indicated otherwise, the number of parts and % in the examples are on a mass basis in all instances.

<Toner-Bearing Member 1 Production Example>

(Substrate Preparation)

An SUS304 core with a diameter of 6 mm was coated with a primer (product name: DY35-051, Dow Corning Toray Co., Ltd.) and baked to prepare a substrate.

(Fabrication of an Elastic Roller)

The substrate was placed in a mold, and an addition-type silicone rubber composition provided by mixing the following materials was injected into the cavity formed within the mold.

| | |
|---|---|
| liquid silicone rubber material (product name: SE6724 A/B, Dow Corning Toray Co., Ltd.) | 100 parts |
| carbon black (product name: TOKABLACK #4300, Tokai Carbon Co., Ltd.) | 15 parts |
| silica particles as an agent for imparting heat resistance | 0.2 parts |
| platinum catalyst | 0.1 parts |

The mold was then heated and the silicone rubber was cured by vulcanization for 15 minutes at a temperature of 150° C. The substrate having a cured silicone rubber layer at the circumference was demolded from the mold, and the substrate was then heated for an additional 1 hour at a temperature of 180° C. to finish the curing reaction of the silicone rubber layer. Proceeding in this manner, an elastic roller was fabricated that had an elastic silicone rubber layer with a diameter of 12 mm formed as a coating on the outer circumference of the substrate.

[Surface Layer Preparation]

(Synthesis of Isocyanate Group-Terminated Prepolymer)

100.0 parts of a polypropylene glycol-type polyol (product name: Excenol 4030; Asahi Glass Co., Ltd.) was gradually added dropwise under a nitrogen atmosphere to 17.7 parts of tolylene diisocyanate (TDI) (product name: Cosmonate T80, Mitsui Chemicals, Inc.) in a reaction vessel while maintaining the temperature in the reaction vessel at 65° C. After the completion of the dropwise addition, a reaction was run for 2 hours at a temperature of 65° C. The obtained reaction mixture was cooled to room temperature to obtain an isocyanate group-terminated prepolymer with an isocyanate group content of 3.8 mass %.

(Synthesis of Amino Compound)

100.0 parts (1.67 mol) of ethylenediamine and 100 parts of pure water were heated to 40° C. while stirring in a reaction vessel fitted with a stirring device, a thermometer, a reflux condenser, a dropwise addition device, and a temperature-regulating apparatus. Then, while maintaining the reaction temperature at not more than 40° C., 425.3 parts (7.35 mol) of propylene oxide was gradually added dropwise over 30 minutes. The reaction was run for an additional 1 hour while stirring to obtain a reaction mixture. The obtained reaction mixture was heated under reduced pressure and the water was distilled off to obtain 426 g of an amino compound.

[Production of Toner-Bearing Member 1]

| | |
|---|---|
| the isocyanate group-terminated prepolymer | 617.9 parts |
| the amino compound | 34.2 parts |
| carbon black (product name: MA230, Mitsubishi Chemical Corporation) | 117.4 parts |
| urethane resin fine particles (product name: Art-pearl C-400, Negami Chemical Industrial Co., Ltd.) | 130.4 parts |
| were stirred and mixed. | |

Methyl ethyl ketone (also referred to hereafter as "MEK") was then added to provide a total solids fraction of 30 mass % followed by mixing with a sand mill. The viscosity was subsequently adjusted to at least 10 cps and not more than 13 cps using MEK to prepare a surface layer-forming coating.

The previously produced elastic roller was immersed in the surface layer-forming coating to form a coating film of this coating on the surface of the elastic layer of the elastic roller and this was followed by drying. A surface layer having a film thickness of 15 μm was then disposed on the outer circumference of the elastic layer by carrying out a heat treatment for 1 hour at a temperature of 150° C. to obtain a toner-bearing member 1.

<Amorphous Polyester (APES1) Production Example>

The starting monomer, with the carboxylic acid component and alcohol component adjusted as shown in Table 1, was introduced into a reaction tank fitted with a nitrogen introduction line, a water separator, a stirrer, and a thermocouple, and 1.5 parts of dibutyltin was added as catalyst per 100 parts of the overall amount of the monomer.

Then, after rapidly raising the temperature to 180° C. at normal pressure under a nitrogen atmosphere, a polycondensation was run while distilling off the water while heating from 180° C. to 210° C. at a rate of 10° C./hour.

After 210° C. had been reached, the pressure within the reaction tank was reduced to 5 kPa or below, and a polycondensation was run under conditions of 210° C. and 5 kPa or below to obtain an amorphous polyester (APES1).

The polymerization time was adjusted so as to provide the value in Table 1 for the peak molecular weight of the amorphous polyester (APES1). The properties of the amorphous polyester (APES1) are given in Table 1.

<Amorphous Polyesters (APES2) to (APES17) Production Example>

Amorphous polyesters (APES2) to (APES17) were obtained proceeding as for amorphous polyester (APES1), but changing the starting monomers and their use amounts as indicated in Table 1. The properties of these amorphous polyesters are given in Table 1.

TABLE 1

| amorphous polyester | | | APES1 | APES2 | APES3 | APES4 | APES5 | APES6 | APES7 | APES8 |
|---|---|---|---|---|---|---|---|---|---|---|
| starting monomer | alcohol component | bisphenol A-2 mol PO adduct | 100 | 95 | 100 | 100 | 100 | 100 | 100 | 100 |
| | | bisphenol A-2 mol EO adduct | — | 5 | — | — | — | — | — | — |
| | carboxylic acid component | terephthalic acid | 67 | 70 | 71 | 67 | 67 | 68 | 66 | 66 |
| | | trimellitic anhydride | 3 | 3 | 2 | 5 | 6 | 1 | 8 | 1 |
| | | fumaric acid (C4) | — | — | — | — | — | — | — | — |
| | | adipic acid (C6) | 20 | 22 | 23 | 19 | 19 | 22 | 26 | 25 |
| | | dodecanedioic acid (C12) | — | — | — | — | — | — | — | — |
| | | stearic acid (molecular chain-terminating component) | 10 | 5 | 4 | 9 | 8 | 9 | — | 8 |
| carboxylic acid component/alcohol component (molar ratio) | | | 0.88 | 0.88 | 0.88 | 0.88 | 0.88 | 0.88 | 0.88 | 0.88 |
| peak molecular weight of amorphous polyester | | | 10000 | 9900 | 10100 | 10200 | 9900 | 10200 | 10500 | 10200 |
| softening point (° C.) | | | 95 | 95 | 97 | 96 | 94 | 96 | 98 | 96 |
| acid value (mgKOH/g) | | | 6.0 | 6.5 | 5.5 | 10.0 | 12.0 | 1.0 | 15 | 0.5 |
| hydroxyl value (mgKOH/g) | | | 20.0 | 40.0 | 43.0 | 25.0 | 28.0 | 26.0 | 43.0 | 30.0 |

| amorphous polyester | | | APES9 | APES10 | APES11 | APES12 | APES13 | APES14 | APES15 | APES16 | APES17 |
|---|---|---|---|---|---|---|---|---|---|---|---|
| starting monomer | alcohol component | bisphenol A-2 mol PO adduct | 100 | 100 | 100 | 100 | 100 | 100 | 100 | 100 | 100 |
| | | bisphenol A-2 mol EO adduct | — | — | — | — | — | — | — | — | — |
| | carboxylic acid | terephthalic acid | 66 | 56 | 51 | 66 | 67 | 76 | 42 | 38 | 90 |

TABLE 1-continued

| | | | | | | | | | | |
|---|---|---|---|---|---|---|---|---|---|---|
| component | trimellitic anhydride | 0 | 5 | 5 | 4 | 4 | 4 | 4 | 4 | 10 |
| | fumaric acid (C4) | — | — | — | — | — | — | 50 | 55 | — |
| | adipic acid (C6) | 26 | 35 | 40 | 20 | 19 | — | — | — | — |
| | dodecanedioic acid (C12) | — | — | — | — | — | 10 | — | — | — |
| | stearic acid (molecular chain-terminating component) | 8 | 4 | 4 | 10 | 10 | 10 | 4 | 3 | — |
| carboxylic acid component/alcohol component (molar ratio) | | 0.88 | 0.82 | 0.81 | 0.92 | 0.93 | 0.93 | 0.82 | 0.81 | 0.90 |
| peak molecular weight of amorphous polyester | | 10300 | 8100 | 7800 | 12900 | 13200 | 13000 | 7800 | 7500 | 10500 |
| softening point (° C.) | | 97 | 85 | 82 | 105 | 108 | 87 | 82 | 80 | 125 |
| acid value (mgKOH/g) | | 0.1 | 9.0 | 10.0 | 7.0 | 8.0 | 7.0 | 8.0 | 9.0 | 8.0 |
| hydroxyl value (mgKOH/g) | | 32 | 38.0 | 40.0 | 17.0 | 22.0 | 24.0 | 40.0 | 40.0 | 51.0 |

The numerical values for the starting monomer in Table 1 are given in mol %.

In addition, with reference to the bisphenol A, "PO" refers to propylene oxide and "EO" refers to ethylene oxide.

<Amorphous Polyester (APES18) Production Example>

100 g of the 2 mol adduct of ethylene oxide on bisphenol A, 189 g of the 2 mol adduct of propylene oxide on bisphenol A, 51 g of terephthalic acid, 61 g of fumaric acid, 25 g of adipic acid, and 2 g of an esterification catalyst (tin octanoate) were introduced into a four-neck flask equipped with a nitrogen introduction line, a water separator, a stirrer, and a thermocouple and a condensation polymerization reaction was run for 8 hours at 230° C.

The reaction was continued for 1 hour at 8 kPa; cooling was carried out to 160° C. followed by the dropwise addition over 1 hour from a dropping funnel of a mixture of 6 g of acrylic acid, 70 g of styrene, 31 g of n-butyl acrylate, and 20 g of a polymerization initiator (di-t-butyl peroxide); and holding was carried out without alteration at 160° C. after the dropwise addition and the addition polymerization reaction was continued for 1 hour.

The temperature was then raised to 200° C. and holding was carried out for 1 hour at 10 kPa, and the unreacted acrylic acid, styrene, and n-butyl acrylate were subsequently removed to obtain an amorphous polyester (APES18), which was a composite resin in which a vinyl polymer segment was bonded with a polyester segment.

<Treated Magnetic Body Production Example>

The following were mixed into an aqueous ferrous sulfate solution to prepare an aqueous solution containing ferrous hydroxide: a sodium hydroxide solution at 1.00 to 1.10 equivalents with reference to the element iron, $P_2O_5$ in an amount that provided 0.15 mass % as the element phosphorus with reference to the element iron, and $SiO_2$ in an amount that provided 0.50 mass % as the element silicon with reference to the element iron. The pH of the aqueous solution was brought to 8.0 and an oxidation reaction was run at 85° C. while blowing in air to prepare a slurry that contained seed crystals.

An aqueous ferrous sulfate solution was then added to this slurry so as to provide 0.90 to 1.20 equivalents with reference to the initial amount of the alkali (sodium component in the sodium hydroxide), after which the oxidation reaction was developed while blowing in air and holding the pH of the slurry at 7.6 to obtain a slurry containing magnetic iron oxide.

After the obtained slurry was filtered and washed, this water-containing slurry was temporarily taken out. At this point, a small amount of the water-containing slurry was collected and the water content was measured.

Then, without drying, the water-containing slurry was introduced into a separate aqueous medium and redispersion was performed with a pin mill while circulating and stirring the slurry and the pH of the redispersion was adjusted to approximately 4.8.

While stirring, an n-hexyltrimethoxysilane coupling agent was added at 1.6 parts per 100 parts of the magnetic iron oxide (the amount of the magnetic iron oxide was calculated as the value provided by subtracting the water content from the water-containing slurry) and hydrolysis was carried out. This was followed by thorough stirring and bringing the pH of the dispersion to 8.6 and the execution of a surface treatment. The produced hydrophobic magnetic body was filtered on a filter press and washed with a large amount of water, followed by drying for 15 minutes at 100° C. and 30 minutes at 90° C. and grinding of the resulting particles to obtain a treated magnetic body having a volume-average particle diameter of 0.21 μm.

<Toner Particle 1 Production Example>

450 parts of a 0.1 mol/L aqueous $Na_3PO_4$ solution was introduced into 720 parts of deionized water; heating to 60° C. was carried out; and 67.7 parts of a 1.0 mol/L aqueous $CaCl_2$ solution was added to obtain an aqueous medium containing a dispersing agent.

| | |
|---|---|
| styrene | 75.0 parts |
| n-butyl acrylate | 25.0 parts |
| amorphous polyester APES1 | 10.0 parts |
| divinylbenzene | 0.6 parts |
| iron complex of monoazo dye (T-77, Hodogaya Chemical Co., Ltd.) | 1.5 parts |
| treated magnetic body | 65.0 parts |

Using an attritor (Mitsui Miike Chemical Engineering Machinery Co., Ltd.), this formulation was dispersed and mixed to uniformity to obtain a monomer composition. This monomer composition was heated to 63° C. and to this was added 15.0 parts of paraffin wax (melting point=78° C.) with mixing and dissolution. This was followed by the dissolution of 5.0 parts of the polymerization initiator tert-butyl peroxypivalate.

The monomer composition described above was introduced into this aqueous medium and granulation was performed by stirring at 60° C. under a nitrogen atmosphere for 10 minutes at 12,000 rpm using a TK Homomixer (Tokushu Kika Kogyo Co., Ltd.). This was followed by reaction for 4 hours at 70° C. while stirring with a paddle stirring blade. After the completion of the reaction, it was confirmed that colored resin particles were dispersed in the resulting aqueous medium and that calcium phosphate was attached as an inorganic dispersing agent to the colored resin particle surface.

At this point, hydrochloric acid was added to the aqueous medium and the calcium phosphate was washed off and removed followed by filtration and drying and analysis of the colored resin particles. According to the results, the glass transition temperature (Tg) of the colored resin particles was 55° C.

The aqueous medium containing the dispersed colored resin particles was then heated to 100° C. and was held for 120 minutes. This was followed by the introduction of 5° C. water into the aqueous medium to effect cooling from 100° C. to 50° C. at a cooling rate of 100° C./minute. The aqueous medium was then held for 120 minutes at 50° C.

Hydrochloric acid was subsequently added to the aqueous medium and the calcium phosphate was washed off and removed followed by filtration and drying to obtain a toner particle 1. The production conditions for toner particle 1 are given in Table 2.

<Production Example for Toner Particles 2 to 30 and Comparative Toner Particles 1 to 4>

Toner particles 2 to 30 and comparative toner particles 1 to 4 were obtained as in the Toner Particle Production Example, but changing the amount of addition of the polymerization initiator, the type and amount of addition of the amorphous polyester and colorant, and the production conditions as indicated in Table 2. The respective production conditions are given in Table 2.

<Comparative Toner Particle 5 Production Example>

(Preparation of Individual Dispersions)

[Resin Particle Dispersion (1)]

| | |
|---|---|
| styrene (Wako Pure Chemical Industries, Ltd.): | 325 parts |
| n-butyl acrylate (Wako Pure Chemical Industries, Ltd.): | 100 parts |
| acrylic acid (Rhodia Nicca, Ltd.): | 13 parts |
| 1,10-decanediol diacrylate (Shin-Nakamura Chemical Co., Ltd.): | 1.5 parts |
| dodecanethiol (Wako Pure Chemical Industries, Ltd.): | 3 parts |

These components were preliminarily mixed and dissolved to prepare a solution; a surfactant solution prepared by the dissolution of 9 parts of an anionic surfactant (Dowfax A211, The Dow Chemical Company) in 580 parts of deionized water was placed in a flask; 400 parts of the aforementioned solution was introduced with dispersion and emulsification; and 6 parts of ammonium persulfate dissolved in 50 parts of deionized water was introduced while gently stirring and mixing for 10 minutes.

The interior of the flask was then thoroughly substituted with nitrogen, after which the interior of the flask was heated on an oil bath to 75° C. while the flask was being stirred. Emulsion polymerization was continued in this state for 5 hours to obtain a resin particle dispersion (1).

When resin particles were separated from the resin particle dispersion (1) and their properties were checked, the number-average particle diameter was 195 nm; the amount of the solids fraction in the dispersion was 42%; the glass transition temperature was 51.5° C.; and the weight-average molecular weight (Mw) was 32,000.

[Resin Particle Dispersion (2)]

Using a disperser provided by modifying a Cavitron CD1010 (EuroTec Ltd.) for high temperature and high pressure operation, an amorphous polyester as described above (APES18) was dispersed. Specifically, for a composition of 79% deionized water, 1% (as the effective component) of an anionic surfactant (Neogen RK, DKS Co. Ltd.), and 20% of the amorphous polyester (APES18), the pH was adjusted to 8.5 with ammonia and a resin fine particle dispersion (2) having a number-average particle diameter of 200 nm was obtained by operating the Cavitron using conditions of a rotor rotation rate of 60 Hz, a pressure of 5 kg/cm$^2$, and 140° C. with heating using a heat exchanger.

[Colorant Dispersion]

| | |
|---|---|
| carbon black: | 20 parts |
| anionic surfactant: (Neogen RK, DKS Co. Ltd.) | 2 parts |
| deionized water: | 78 parts |

Using a homogenizer (Ultra-Turrax T50, IKA-Werke GmbH & Co. KG), these components was dispersed for 2 minutes at 3,000 rpm to moderately blend the pigment with the water and was then dispersed for 10 minutes at 5,000 rpm. Defoaming was subsequently carried out by stirring for 24 hours with a common stirrer, followed by dispersion for approximately 1 hour at a pressure of 240 MPa using an Altimizer (HJP30006, Sugino Machine Limited) high-pressure impact-type disperser to obtain a colorant dispersion. The pH of this dispersion was also adjusted to 6.5.

[Release Agent Dispersion]

| | |
|---|---|
| hydrocarbon wax: (Fischer-Tropsch wax, peak temperature of maximum endothermic peak = 78° C., weight-average molecular weight = 750) | 45 parts |
| anionic surfactant (Neogen RK, DKS Co. Ltd.): | 5 parts |
| deionized water: | 200 parts |

These components were heated to 95° C. and were thoroughly dispersed using a homogenizer (Ultra-Turrax T50, IKA-Werke GmbH & Co. KG) and were then subjected to dispersion processing using a Gaulin pressure ejection homogenizer to obtain a release agent dispersion having a solids fraction of 25% and a number-average diameter of 190 nm.

[Toner Particle Production Example]

| | |
|---|---|
| deionized water: | 400 parts |
| resin particle dispersion (1): (resin particle concentration: 42%) | 620 parts |
| resin particle dispersion (2): (resin particle concentration: 20%) | 279 parts |
| anionic surfactant: (0.9 parts as the effective component) (Neogen RK, effective component amount: 60%, DKS Co. Ltd.) | 1.5 parts |

These components were introduced into a 3-L reaction vessel fitted with a thermometer, pH meter, and stirrer and were held for 30 minutes at a stirring rotation rate of 150 rpm and a temperature of 30° C. while controlling the temperature from the outside using a mantle heater.

After this, 88 parts of the colorant dispersion and 60 parts of the release agent dispersion were introduced and holding was carried out for 5 minutes. In this same condition, a 1.0% aqueous nitric acid solution was added to adjust the pH to 3.0.

The stirrer and mantle heater were then removed; ½ of a mixed solution of 0.33 parts of polyaluminum chloride and 37.5 parts of a 0.1% aqueous nitric acid solution was added while dispersing at 3,000 rpm using a homogenizer (Ultra-Turrax T50, IKA-Werke GmbH & Co. KG); the dispersion rotation rate was then brought to 5,000 rpm and the remaining ½ was added over 1 minute; and the dispersion rotation rate was brought to 6,500 rpm and dispersion was carried out for 6 minutes.

A stirrer and mantle heater were installed on the reaction vessel and, while adjusting the rotation rate of the stirrer as appropriate to provide thorough stirring of the slurry, the temperature was raised to 42° C. at 0.5° C./minute and holding was carried out for 15 minutes at 42° C. After this, while raising the temperature at 0.05° C./minute, the particle diameter was measured every 10 minutes using a Coulter Multisizer, and, when the weight-average particle diameter became 7.8 μm, the pH was brought to 9.0 using a 5% aqueous sodium hydroxide solution.

Then, while adjusting the pH to 9.0 every 5° C., the temperature was raised to 96° C. at a ramp rate of 1° C./minute and holding was carried out at 96° C. The particle shape and surface properties were observed every 30 minutes using an optical microscope and a scanning electron microscope (FE-SEM), and an approximately spherical shape was assumed in the 2nd hour and the particles were then solidified by cooling to 20° C. at 1° C./minute.

The reaction product was then filtered and washed with deionized water by throughflow until the conductivity of the filtrate was not more than 50 mS; the particles, which had assumed the form of a cake, were taken out and were introduced into deionized water in an amount that was 10-fold that of the mass of the particles; the particles were thoroughly deaggregated by stirring with a Three-One motor; the pH was adjusted to 3.8 with a 1.0% aqueous nitric acid solution; and holding was carried out for 10 minutes.

This was followed by another filtration and washing by water throughflow, and, when the conductivity of the filtrate reached 10 mS or less, water throughflow was stopped and solid-liquid separation was performed.

The resulting particles, which had assumed the form of a cake, were ground with a sample mill and dried for 24 hours in a 40° C. oven. The obtained powder was ground with a sample mill and was then subjected to an additional vacuum drying for 5 hours in a 40° C. oven to obtain a comparative toner particle 5.

TABLE 2

| | polymerization initiator | amorphous polyester | | colorant | | | | |
|---|---|---|---|---|---|---|---|---|
| toner particle No. | amount of addition [parts] | type | amount of addition [parts] | type | amount of addition [parts] | A [min] | B [° C./min] | C [min] |
| 1 | 6.0 | APES1 | 10.0 | treated magnetic body | 65.0 | 120 | 100 | 120 |
| 2 | 6.0 | APES2 | 10.0 | treated magnetic body | 65.0 | 120 | 100 | 120 |
| 3 | 6.0 | APES3 | 10.0 | treated magnetic body | 65.0 | 120 | 100 | 120 |
| 4 | 9.0 | APES1 | 10.0 | treated magnetic body | 65.0 | 120 | 100 | 120 |
| 5 | 9.5 | APES1 | 10.0 | treated magnetic body | 65.0 | 120 | 100 | 120 |
| 6 | 3.5 | APES1 | 10.0 | treated magnetic body | 65.0 | 120 | 100 | 120 |
| 7 | 3.0 | APES1 | 10.0 | treated magnetic body | 65.0 | 120 | 100 | 120 |
| 8 | 6.0 | APES4 | 15.0 | treated magnetic body | 65.0 | 120 | 100 | 120 |
| 9 | 6.0 | APES5 | 15.0 | treated magnetic body | 65.0 | 120 | 100 | 120 |
| 10 | 6.0 | APES6 | 7.0 | treated magnetic body | 65.0 | 60 | 100 | 120 |
| 11 | 6.0 | APES6 | 5.0 | treated magnetic body | 65.0 | 30 | 100 | 120 |
| 12 | 6.0 | APES7 | 10.0 | treated magnetic body | 65.0 | 120 | 100 | 120 |
| 13 | 6.0 | APES7 | 10.0 | treated magnetic body | 65.0 | 120 | 5 | 120 |
| 14 | 6.0 | APES8 | 5.0 | treated magnetic body | 65.0 | 30 | 100 | 120 |
| 15 | 6.0 | APES9 | 5.0 | treated magnetic body | 65.0 | 30 | 100 | 120 |
| 16 | 6.0 | APES6 | 4.0 | treated magnetic body | 65.0 | 120 | 100 | 120 |
| 17 | 6.0 | APES1 | 30.0 | treated magnetic body | 65.0 | 120 | 100 | 120 |
| 18 | 6.0 | APES1 | 33.0 | treated magnetic body | 65.0 | 120 | 5 | 120 |
| 19 | 6.0 | APES10 | 10.0 | treated magnetic body | 65.0 | 120 | 100 | 120 |
| 20 | 6.0 | APES11 | 10.0 | treated magnetic body | 65.0 | 120 | 100 | 120 |
| 21 | 5.0 | APES12 | 10.0 | treated magnetic body | 65.0 | 120 | 100 | 120 |
| 22 | 6.0 | APES13 | 10.0 | treated magnetic body | 65.0 | 120 | 100 | 120 |
| 23 | 6.0 | APES14 | 10.0 | treated magnetic body | 65.0 | 120 | 100 | 120 |
| 24 | 6.0 | APES15 | 10.0 | treated magnetic body | 65.0 | 120 | 100 | 120 |
| 25 | 6.5 | APES16 | 10.0 | treated magnetic body | 65.0 | 120 | 5 | 120 |
| 26 | 3.0 | APES1 | 10.0 | treated magnetic body | 65.0 | 120 | 100 | 120 |
| 27 | 10.0 | APES1 | 10.0 | treated magnetic body | 65.0 | 120 | 100 | 120 |
| 28 | 6.0 | APES1 | 10.0 | carbon black | 8.0 | 120 | 100 | 120 |
| 29 | 6.0 | APES1 | 5.0 | carbon black | 8.0 | 30 | 100 | 120 |
| 30 | 6.0 | APES1 | 30.0 | carbon black | 8.0 | 120 | 100 | 120 |
| comparative 1 | 2.5 | APES1 | 10.0 | treated magnetic body | 65.0 | 120 | 100 | 120 |
| comparative 2 | 11.0 | APES1 | 10.0 | treated magnetic body | 65.0 | 120 | 5 | 120 |
| comparative 3 | 6.0 | APES16 | 33.0 | treated magnetic body | 65.0 | 120 | 5 | 120 |
| comparative 4 | 6.0 | APES17 | 10.0 | treated magnetic body | 65.0 | 30 | 1 | 0 |
| comparative 5 | | | | described in text | | | | |

carbon black (product name: MA-100, Mitsubishi Chemical Corporation)

polymerization initiator: tert-butyl peroxypivalate The A, B, and C in Table 2 denote the following.

A: after completion of the polymerization reaction, the holding time [min] after the aqueous medium containing the dispersed colored resin particles has been heated to 100° C.

B: the cooling rate [° C./min] to a temperature (50° C.) equal to or less than the glass transition temperature of the colored resin particles C: holding time [min] at a temperature (50° C.) equal to or less than the glass transition temperature of the colored resin particles <Toner 1 Production Example>

100 parts of toner particle 1 and 1.2 parts of hydrophobic silica fine particles having a BET specific surface area value of 120 $m^2/g$ (provided by the treatment of silica fine particles having a number-average primary particle diameter of 12 nm with hexamethyldisilazane followed by treatment with silicone oil) were mixed using a Henschel mixer (Mitsui Miike Chemical Engineering Machinery Co., Ltd.) to prepare a toner 1. The properties of toner 1 are given in Table 3.

<Production Example for Toners 2 to 27 and Comparative Toners 1 to 4>

Toners 2 to 27 and comparative toners 1 to 4 were obtained proceeding as in the Toner 1 Production Example, but changing the toner particle as indicated in Table 3. The properties of toners 2 to 27 and comparative toners 1 to 4 are shown in Table 3.

<Production Example for Toners 28 to 30 and Comparative Toner 5>

Toners 28 to 30 and comparative toner 5 were obtained proceeding as in the Toner 1 Production Example, but changing the toner particle as indicated in Table 3 and changing the amount of addition of the silica fine particles from 1.2 parts to 1.8 parts. The properties of toners 28 to 30 and comparative toner 5 are shown in Table 3.

TABLE 3

| toner No. | toner particle No. | D | E | F | G | H | I | J | K | L | M | N | O | P |
|---|---|---|---|---|---|---|---|---|---|---|---|---|---|---|
| 1 | 1 | 8.0 | 0.975 | 55 | 22000 | 10 | 125 | 5 | 40 | 50 | 91 | 1.22 | 1.0 | 2.00 |
| 2 | 2 | 7.9 | 0.972 | 54 | 22000 | 10 | 125 | 6 | 42 | 55 | 92 | 1.49 | 2.0 | 2.10 |
| 3 | 3 | 8.0 | 0.973 | 55 | 22000 | 10 | 126 | 6 | 42 | 58 | 93 | 1.66 | 2.2 | 2.20 |
| 4 | 4 | 7.8 | 0.974 | 55 | 15000 | 10 | 118 | 6 | 42 | 55 | 92 | 1.49 | 0.7 | 2.10 |
| 5 | 5 | 8.0 | 0.975 | 54 | 14500 | 10 | 115 | 7 | 43 | 58 | 93 | 1.66 | 0.6 | 2.10 |
| 6 | 6 | 7.8 | 0.974 | 55 | 30000 | 10 | 135 | 5 | 39 | 52 | 91 | 1.33 | 1.7 | 1.90 |
| 7 | 7 | 8.1 | 0.973 | 54 | 31000 | 10 | 137 | 5 | 36 | 50 | 91 | 1.22 | 1.8 | 1.80 |
| 8 | 8 | 8.2 | 0.972 | 55 | 22000 | 15 | 127 | 7 | 42 | 60 | 94 | 1.76 | 1.3 | 3.00 |
| 9 | 9 | 7.9 | 0.971 | 54 | 23000 | 15 | 130 | 7 | 43 | 62 | 94 | 1.94 | 1.4 | 3.10 |
| 10 | 10 | 7.9 | 0.970 | 55 | 23000 | 7 | 129 | 5 | 35 | 37 | 82 | 0.82 | 0.9 | 0.30 |
| 11 | 11 | 8.0 | 0.972 | 54 | 23000 | 5 | 128 | 5 | 33 | 32 | 80 | 0.67 | 0.9 | 0.27 |
| 12 | 12 | 7.9 | 0.973 | 55 | 23000 | 10 | 126 | 7 | 45 | 70 | 97 | 2.59 | 2.2 | 3.50 |
| 13 | 13 | 8.1 | 0.972 | 54 | 23000 | 10 | 126 | 8 | 45 | 74 | 99 | 2.96 | 3.0 | 4.00 |
| 14 | 14 | 8.2 | 0.974 | 55 | 22000 | 5 | 128 | 5 | 32 | 30 | 80 | 0.60 | 0.6 | 0.25 |
| 15 | 15 | 8.0 | 0.972 | 55 | 23000 | 5 | 129 | 5 | 31 | 28 | 77 | 0.57 | 0.3 | 0.23 |
| 16 | 16 | 8.1 | 0.973 | 54 | 23000 | 4 | 129 | 5 | 31 | 30 | 78 | 0.63 | 0.9 | 0.25 |
| 17 | 17 | 7.9 | 0.968 | 55 | 23000 | 20 | 125 | 7 | 45 | 68 | 96 | 2.43 | 1.4 | 2.40 |
| 18 | 18 | 7.9 | 0.966 | 54 | 22000 | 25 | 125 | 5 | 47 | 72 | 99 | 2.67 | 1.6 | 2.80 |
| 19 | 19 | 7.9 | 0.973 | 54 | 23000 | 10 | 124 | 6 | 45 | 52 | 90 | 1.37 | 0.8 | 2.80 |
| 20 | 20 | 8.0 | 0.969 | 55 | 21000 | 10 | 127 | 8 | 48 | 55 | 91 | 1.53 | 1.8 | 2.90 |
| 21 | 21 | 8.0 | 0.968 | 55 | 24000 | 10 | 132 | 5 | 31 | 45 | 88 | 1.05 | 1.9 | 1.80 |
| 22 | 22 | 8.1 | 0.971 | 55 | 23000 | 10 | 133 | 5 | 30 | 42 | 87 | 0.93 | 2.3 | 1.60 |
| 23 | 23 | 8.1 | 0.972 | 55 | 22000 | 10 | 128 | 6 | 33 | 45 | 89 | 1.02 | 3.0 | 1.90 |
| 24 | 24 | 8.1 | 0.973 | 54 | 23000 | 10 | 126 | 8 | 46 | 65 | 94 | 2.24 | 0.6 | 2.90 |
| 25 | 25 | 8.2 | 0.974 | 55 | 21000 | 10 | 125 | 10 | 48 | 68 | 97 | 2.34 | 0.7 | 3.00 |
| 26 | 26 | 8.0 | 0.972 | 54 | 34000 | 10 | 140 | 5 | 32 | 45 | 88 | 1.05 | 1.8 | 1.50 |
| 27 | 27 | 7.9 | 0.974 | 55 | 13000 | 10 | 110 | 9 | 45 | 63 | 94 | 2.03 | 1.2 | 2.30 |
| 28 | 28 | 7.9 | 0.972 | 54 | 22000 | 10 | 125 | 5 | 34 | 45 | 89 | 1.02 | 1.1 | 1.50 |
| 29 | 29 | 8.0 | 0.973 | 55 | 22000 | 5 | 125 | 5 | 30 | 30 | 77 | 0.64 | 0.8 | 1.20 |
| 30 | 30 | 8.0 | 0.971 | 54 | 22000 | 20 | 125 | 5 | 40 | 60 | 92 | 1.88 | 1.5 | 2.50 |
| comparative 1 | comparative 1 | 8.0 | 0.970 | 54 | 36000 | 10 | 143 | 5 | 31 | 42 | 86 | 0.95 | 1.9 | 1.30 |
| comparative 2 | comparative 2 | 8.1 | 0.971 | 54 | 12000 | 10 | 105 | 10 | 48 | 67 | 95 | 2.39 | 0.8 | 2.50 |
| comparative 3 | comparative 3 | 8.0 | 0.962 | 55 | 21000 | 33 | 120 | 12 | 52 | 69 | 97 | 2.46 | 0.8 | 2.50 |
| comparative 4 | comparative 4 | 8.1 | 0.962 | 54 | 23000 | 10 | 135 | 5 | 25 | ND | ND | — | — | 4.00 |
| comparative 5 | comparative 5 | 7.9 | 0.943 | 55 | 24000 | 21 | 109 | 8 | 27 | 38 | 75 | 1.03 | 0.2 | 3.80 |

The D, E, F, G, H, I, J, K, L, M, N, O, P, and ND in Table 3 denote the following.

D: weight-average particle diameter (D4) of the toner [μm]

E: average circularity of the toner

F: glass transition temperature (Tg) of the toner [° C.]

G: peak molecular weight of the toner (Mp(T))

H: content of amorphous polyester [mass parts]

I: softening point of the toner [° C.]

J: integrated value f1 for the stress of the toner [g · m/sec]

K: integrated value f2 for the stress of the toner [g · m/sec]

L: 25% area ratio [area %]

M: 50% area ratio [area %]

N: domain area ratio

O: number-average diameter of the amorphous polyester domains [μm]

P: S211/S85

ND: not determined

Example 1

A modified LBP7700C printer from Canon, Inc. was used for the image output evaluations. The modifications were as follows: the toner-bearing member was changed to toner-bearing member 1; the toner feed member in the developing apparatus was made to rotate in reverse to the toner-bearing member, as shown in FIG. 2; and voltage application to the toner feed member was turned off.

The contact pressure was adjusted to bring the width of the contact region between the toner-bearing member and the electrostatic latent image-bearing member to 1.1 mm. In addition, the voltage applied to the toner-bearing member was modified from the finished product condition to enable it to be 200 V higher than the finished product condition. (For example, if the voltage applied to the toner-bearing member in the finished product is −600 V, the condition of 200 V higher than the finished product condition is −400 V.)

The cleaning blade was removed as shown in FIG. 3, and the process speed was modified to be 25 ppm or 30 ppm.

These modifications make it possible to carry out rigorous evaluations.

100 g of toner 1 was filled into the developing apparatus modified as indicated above and the following evaluations were carried out in a high-temperature, high-humidity environment (32.5° C./80% RH).

According to the results, excellent images free of image defects could be obtained in a high-temperature, high-humidity environment even in a cleanerless system. The results of the evaluations are given in Table 4.

The evaluation methods used in the individual evaluations and their scoring criteria are described in the following.

[Fixation Tailing]

(Evaluation 1)

The frequency and degree of fixation tailing were visually evaluated when 2,000 sheets of horizontal lines with a print percentage of 1% were printed at a process speed of 25 ppm using two-sheet intermittent paper feed followed by a 50-sheet paper feed printing horizontal lines at a print percentage of 1%.

(Evaluation 2)

The frequency and degree of fixation tailing were visually evaluated when 2,000 sheets of horizontal lines with a print percentage of 1% were printed at a process speed of 30 ppm using two-sheet intermittent paper feed followed by a 50-sheet paper feed printing horizontal lines at a print percentage of 1%.

A: fixation tailing is not produced

B: fixation tailing is produced on at least 1 sheet and not more than 5 sheets; the degree is also very minor C: fixation tailing is produced on at least 6 sheets and not more than 10 sheets; the degree is also minor D: fixation tailing is produced on 11 or more sheets

[Development Ghosts]

(Evaluation 1)

After printing 2,000 sheets of horizontal lines with a print percentage of 1% at a process speed of 25 ppm using two-sheet intermittent paper feed, or (Evaluation 2)

After printing 4,000 sheets of horizontal lines with a print percentage of 1% at a process speed of 25 ppm using two-sheet intermittent paper feed, a plurality of 10 mm×10 mm solid images were formed on the front half of the transfer paper and a 2-dot/3-space halftone image was formed on the back half. A visual inspection was then made of the degree to which traces of the solid image appeared on the halftone image.

A: ghosting is not produced

B: very minor ghosting is produced

C: minor ghosting is produced

D: significant ghosting is produced

[Transferability]

(Evaluation 1)

After printing 2,000 sheets of horizontal lines with a print percentage of 1% at a process speed of 25 ppm using two-sheet intermittent paper feed, or (Evaluation 2)

After printing 4,000 sheets of horizontal lines with a print percentage of 1% at a process speed of 25 ppm using two-sheet intermittent paper feed, the untransferred toner on the electrostatic latent image-bearing member at the time of solid image formation was taped with a transparent polyester pressure-sensitive tape (product name: Polyester Tape No. 5511, supplier: Nichiban Co., Ltd.) and then stripped off. For each case, the density difference was calculated by subtracting the density for only the pressure-sensitive tape pasted on paper from the density for the stripped-off pressure-sensitive tape pasted on paper.

The density was measured using a Reflectometer Model TC-6DS from Tokyo Denshoku Co., Ltd. A green filter was used for the filter.

A: very good—the density difference is less than 0.05

B: good—the density difference is at least 0.05 and less than 0.10

C: the density difference is at least 0.10 and less than 0.15

D: the density difference is 0.15 or greater

Examples 2 to 30

Each of the evaluations was carried out as in Example 1, but changing the toner as indicated in Table 4. According to the results, images that were free of image defects and that had excellent image densities could be obtained in the high-temperature, high-humidity environment. The results of the evaluations are given in Table 4.

Comparative Examples 1 to 5

Each of the evaluations was carried out as in Example 1, but changing the toner as indicated in Table 4. According to the results, image defects were produced in the high-temperature, high-humidity environment. The results of the evaluations are given in Table 4.

TABLE 4

| | | in high-temperature, high-humidity environment (32.5° C., 80% RH) | | | | | |
|---|---|---|---|---|---|---|---|
| | | fixation tailing | | development ghosts | | transferability | |
| Example No. | Toner No. | after 2000 sheets at 25 ppm (sheets) | after 2000 sheets at 30 ppm (sheets) | after 2000 sheets at 25 ppm | after 4000 sheets at 25 ppm | after 2000 sheets at 25 ppm (density difference) | after 4000 sheets at 25 ppm (density difference) |
| 1 | 1 | A | A | A | A | A (0.01) | A (0.01) |
| 2 | 2 | A | A | A | A | A (0.02) | B (0.05) |
| 3 | 3 | A | A | A | A | B (0.05) | B (0.08) |
| 4 | 4 | A | A | A | B | A (0.02) | A (0.03) |
| 5 | 5 | A | A | B | B | A (0.03) | A (0.04) |
| 6 | 6 | A | B (1) | A | A | A (0.01) | A (0.02) |
| 7 | 7 | B (1) | B (2) | A | A | A (0.01) | A (0.02) |
| 8 | 8 | A | A | A | B | B (0.05) | B (0.07) |
| 9 | 9 | A | A | B | B | B (0.06) | B (0.08) |
| 10 | 10 | B (2) | B (4) | A | A | A (0.02) | A (0.03) |
| 11 | 11 | B (4) | B (5) | A | A | A (0.02) | A (0.03) |
| 12 | 12 | A | B (2) | B | B | B (0.05) | B (0.06) |
| 13 | 13 | A | B (2) | B | C | B (0.06) | B (0.08) |
| 14 | 14 | B (4) | B (5) | A | A | A (0.03) | B (0.06) |
| 15 | 15 | B (5) | C (7) | A | A | B (0.05) | B (0.06) |
| 16 | 16 | B (5) | C (9) | A | A | A (0.03) | B (0.06) |
| 17 | 17 | A | B (1) | B | C | C (0.10) | C (0.12) |
| 18 | 18 | A | B (3) | C | C | C (0.11) | C (0.14) |
| 19 | 19 | A | B (2) | B | C | B (0.07) | C (0.11) |
| 20 | 20 | B (1) | B (2) | B | C | C (0.11) | C (0.13) |
| 21 | 21 | B (4) | C (6) | A | A | A (0.01) | A (0.02) |
| 22 | 22 | C (6) | C (8) | A | A | A (0.01) | A (0.01) |
| 23 | 23 | B (1) | B (2) | A | B | A (0.02) | A (0.03) |
| 24 | 24 | B (2) | B (3) | B | C | C (0.11) | C (0.13) |
| 25 | 25 | B (4) | C (6) | B | C | C (0.12) | C (0.14) |
| 26 | 26 | C (6) | C (8) | A | A | A (0.01) | A (0.01) |
| 27 | 27 | A | B (2) | B | C | B (0.07) | C (0.12) |
| 28 | 28 | A | A | A | A | A (0.01) | A (0.01) |
| 29 | 29 | B (4) | C (7) | A | A | A (0.03) | B (0.07) |
| 30 | 30 | A | A | A | B | B (0.05) | B (0.08) |
| comparative 1 | comparative 1 | C (8) | D (15) | A | A | A (0.01) | A (0.01) |
| comparative 2 | comparative 2 | A | B (5) | C | D | C (0.13) | D (0.17) |
| comparative 3 | comparative 3 | B (2) | B (4) | C | D | C (0.14) | D (0.18) |
| comparative 4 | comparative 4 | D (11) | D (15) | B | C | B (0.06) | C (0.11) |
| comparative 5 | comparative 5 | C (8) | D (11) | C | D | C (0.13) | D (0.17) |

The present invention can provide a toner that, even during long-term use, can yield images for which development ghosts and fixation tailing are suppressed. The present invention can also provide a developing apparatus and image forming apparatus that are provided with this toner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-130188, filed, Jun. 30, 2016, which is hereby incorporated by reference herein in its entirety.

What is claimed is:

1. A toner comprising:

a toner particle containing a binder resin, an amorphous polyester, and a colorant, wherein a softening point of the toner is 110 to 140° C., an integrated value f1 for stress of the toner is not more than 10 g·m/sec, as measured using a tack tester, with a temperature for a probe end being 150° C. and a press holding time being 0.01 seconds, and an integrated value f2 for stress of the toner is at least 30 g·m/sec, as measured using a tack tester, with a temperature for a probe end being 150° C. and a press holding time being 0.1 seconds.

2. The toner according to claim 1, wherein the binder resin contains a vinyl resin, the amorphous polyester has a monomer unit derived from a linear aliphatic dicarboxylic acid having 6 to 12 carbons and a monomer unit derived from an alcohol component, and a content of the monomer unit derived from a linear aliphatic dicarboxylic acid having 6 to 12 carbons is 10 to 50 mol % relative to a total monomer unit derived from a carboxylic acid component constituting the amorphous polyester.

3. The toner according to claim 2, wherein in a cross section of the toner particle observed with a transmission electron microscope, the vinyl resin forms a matrix and the amorphous polyester forms a domain, and a proportion for the domain of the amorphous polyester present in a region within 25% of a distance from a contour of the cross section to a centroid of the cross section is 30 to 70 area % relative to a total area of the domain of the amorphous polyester.

4. The toner according to claim 2, wherein in a cross section of the toner particle observed with a transmission electron microscope, the vinyl resin forms a matrix and the amorphous polyester forms a domain, and a proportion for the domain of the amorphous polyester present in a region within 50% of a distance from a contour of the cross section to a centroid of the cross section is 80 to 100 area % relative to a total area of the domain of the amorphous polyester.

5. The toner according to claim 2, wherein in a cross section of the toner particle observed with a transmission electron microscope, the vinyl resin forms a matrix and the amorphous polyester forms a domain, and A/B ≥1.05 when A is an area of the domain of the amorphous polyester present in a region within 25% of a distance from a contour of the cross section to a centroid of the cross section, and B is an area of the domain of the amorphous polyester present in a region that is 25% to 50% of the distance from a contour of the cross section to a centroid of the cross section.

6. The toner according to claim 2, wherein in a cross section of the toner particle observed with a transmission electron microscope, the vinyl resin forms a matrix and the amorphous polyester forms a domain, and a number-average diameter of the domain of the amorphous polyester is 0.3 to 3.0 μm.

7. The toner according to claim 2, wherein in an analysis of the toner by time-of-flight secondary ion mass spectrometry, 0.30 ≥S211/S85≥3.00 when S85 is a peak intensity derived from the vinyl resin and S211 is a peak intensity derived from the amorphous polyester.

8. The toner according to claim 1, wherein a peak molecular weight of the amorphous polyester is 8,000 to 13,000, and a softening point of the amorphous polyester is 85 to 105° C.

9. The toner according to claim 1, wherein the content of the amorphous polyester is 5 to 30 mass parts per 100 mass parts of the binder resin.

10. The toner according to claim 1, wherein an acid value of the amorphous polyester is 1.0 to 10.0 mg KOH/g.

11. The toner according to claim 1, wherein a peak molecular weight of the toner is 15,000 to 30,000.

12. The toner according to claim 1, wherein a hydroxyl value of the amorphous polyester is not more than 40.0 mg KOH/g.

13. The toner according to claim 1, wherein the colorant comprises a magnetic body.

14. A toner comprising:

a toner particle containing a colorant, an amorphous polyester, and a binder resin containing a vinyl resin, wherein a softening point of the toner is 110 to 140° C., the amorphous polyester has a monomer unit derived from a linear aliphatic dicarboxylic acid having 6 to 12 carbons and a monomer unit derived from an alcohol component, a content of the monomer unit derived from a linear aliphatic dicarboxylic acid having 6 to 12 carbons is 10 to 50 mol % relative to a total monomer unit derived from a carboxylic acid component constituting the amorphous polyester, and in a cross section of the toner particle observed with a transmission electron microscope, the vinyl resin forms a matrix and the amorphous polyester forms a domain where a number-average diameter of the domain of the amorphous polyester is 0.3 to 3.0μm, and a proportion for the domain of the amorphous polyester present in a region within 25% of a distance from a contour of the cross section to a centroid of the cross section is 30 to 70 area % relative to a total area of the domain of the amorphous polyester.

15. An image forming apparatus comprising:

an electrostatic latent image bearing member;

a charging member for charging the electrostatic latent image bearing member;

a toner comprising a toner particle containing a binder resin, an amorphous polyester, and a colorant, for developing an electrostatic latent image formed on the electrostatic latent image bearing member; and a toner bearing member for contacting the electrostatic latent image bearing member and transporting the toner, and recovering the toner remaining on the electrostatic latent image bearing member after transfer, wherein a softening point of the toner is 110 to 140° C.;

an integrated value f1 for stress of the toner is not more than 10 g·m/sec, as measured using a tack tester, with a temperature for a probe end being 150° C. and a press holding time being 0.01 seconds; and an integrated value f2 for stress of the toner is at least 30 g·m/sec, as measured using a tack tester, with a temperature for a probe end being 150° C. and a press holding time being 0.1 seconds.

* * * * *